US012262767B2

(12) United States Patent
Barton

(10) Patent No.: US 12,262,767 B2
(45) Date of Patent: Apr. 1, 2025

(54) LACES WITH TYING MECHANISMS AND RELATED METHODS

(71) Applicant: RBCN Holding LLC, Keller, TX (US)

(72) Inventor: Richard Barton, Champaign, IL (US)

(73) Assignee: RBCN Holding LLC, Keller, TX (US)

( * ) Notice: Subject to any disclaimer, the term of this patent is extended or adjusted under 35 U.S.C. 154(b) by 0 days.

(21) Appl. No.: 18/509,289

(22) Filed: Nov. 14, 2023

(65) Prior Publication Data

US 2024/0081448 A1 Mar. 14, 2024

Related U.S. Application Data

(63) Continuation of application No. 17/733,596, filed on Apr. 29, 2022.

(51) Int. Cl.

| | |
|---|---|
| ***A43C 7/00*** | (2006.01) |
| ***A41D 19/00*** | (2006.01) |
| ***A43C 7/08*** | (2006.01) |

(52) U.S. Cl.

CPC ..... *A41D 19/0044* (2013.01); *A43C 7/08* (2013.01)

(58) Field of Classification Search

CPC ..... A43C 7/08; A43D 19/0044

See application file for complete search history.

(56) References Cited

U.S. PATENT DOCUMENTS 181,011 A * 8/1876 Ranniger ..... A41D 19/0044 D2/621
198,921 A * 1/1878 Butts ..... A41D 19/0044 D2/619
317,528 A * 5/1885 Forbes ..... A43C 7/00 24/712
373,470 A * 11/1887 Morrison ..... A41D 19/0044 2/162
410,999 A * 9/1889 Young ..... A41D 19/0044 2/162
673,157 A * 4/1901 Burnham ..... A41D 19/0044 24/904
704,579 A * 7/1902 Rollason ..... A41D 19/0044 2/162

(Continued)

FOREIGN PATENT DOCUMENTS

CN 211328096 U 8/2020

OTHER PUBLICATIONS

International Search Report and Written Opinion on corresponding PCT application (PCT/US2023/020247) from International Searching Authority (KR) dated Sep. 12, 2023.

(Continued)

*Primary Examiner* — Katharine G Kane
(74) *Attorney, Agent, or Firm* — Alumen IP Law PC

(57) ABSTRACT

A tying system or mechanism with at least one lace and a fastener element can be used with a boxing glove or a shoe to allow a user to secure the at least one lace around the boxing glove or shoe without a second person and/or without tying a knot. The tying mechanism can include a back-to-back hook and loop of a fastener element and can include or more locking mechanisms to anchor free ends of the one or more laces at the eyelets of the boxing glove or shoe. The tying mechanism can generate a force that is radial or lateral to a gap defined by flaps of the boxing glove or shoes.

25 Claims, 11 Drawing Sheets

(56) References Cited

U.S. PATENT DOCUMENTS 1,088,067 A * 2/1914 Forbes ..... A43C 1/00 24/713.6
1,407,705 A * 2/1922 Munter ..... A41F 1/04 450/119
1,523,816 A * 1/1925 Lobbenberg ..... A41F 1/04 24/713.6
3,663,960 A * 5/1972 Kennedy ..... A63B 71/145 2/18
4,081,916 A 4/1978 Salisbury
4,295,228 A * 10/1981 Dragomir ..... A63B 71/145 2/18
4,424,595 A 1/1984 Albert
5,027,482 A 7/1991 Torppey
5,353,483 A * 10/1994 Louviere ..... A43C 11/1493 24/712.1
5,572,777 A * 11/1996 Shelton ..... A43C 7/00 24/712
6,014,770 A * 1/2000 Spector ..... A63B 71/145 2/161.1
6,178,553 B1 1/2001 Bolton
6,202,213 B1 3/2001 Georgick
6,295,704 B1 10/2001 Rivas
6,704,936 B1 3/2004 Carlin
D732,747 S 6/2015 Phillips et al.
9,067,123 B1 * 6/2015 Robbins ..... A41D 19/01547
2003/0051374 A1 * 3/2003 Freed ..... A43C 11/008 36/50.1
2004/0078999 A1 * 4/2004 Freed ..... A43C 11/008 36/50.1
2008/0083136 A1 4/2008 McNeely
2008/0127511 A1 * 6/2008 Friton ..... A43C 11/008 36/50.1
2009/0038128 A1 * 2/2009 Cho ..... A43C 11/1493 24/68 SK
2009/0100707 A1 * 4/2009 Bar ..... A43C 11/008 36/50.1
2013/0283639 A1 10/2013 Williams et al.
2014/0215675 A1 * 8/2014 Clauder ..... A63B 71/145 2/18
2015/0287475 A1 10/2015 Kim et al.
2016/0095390 A1 * 4/2016 Sanders ..... A43C 7/005 24/712.2
2016/0128859 A1 * 5/2016 Brandt ..... A63B 21/4017 602/63
2017/0282048 A1 10/2017 Wittman
2018/0133582 A1 * 5/2018 Sharp ..... A41D 13/088
2018/0369679 A1 12/2018 Barton
2020/0000160 A1 * 1/2020 Dunn ..... A41D 19/01
2021/0016153 A1 * 1/2021 Roddy ..... A41D 19/0044

OTHER PUBLICATIONS

Non-Final Office Action on related US application (U.S. Appl. No. 15/914,645) dated Jul. 17, 2020.
Non-Final Office Action on related US application (U.S. Appl. No. 16/848,629) dated Dec. 24, 2021.

* cited by examiner

FIG. 8
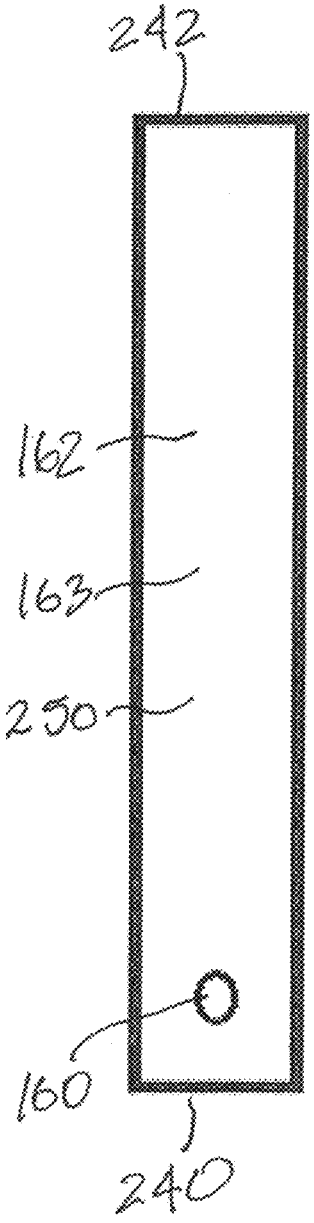
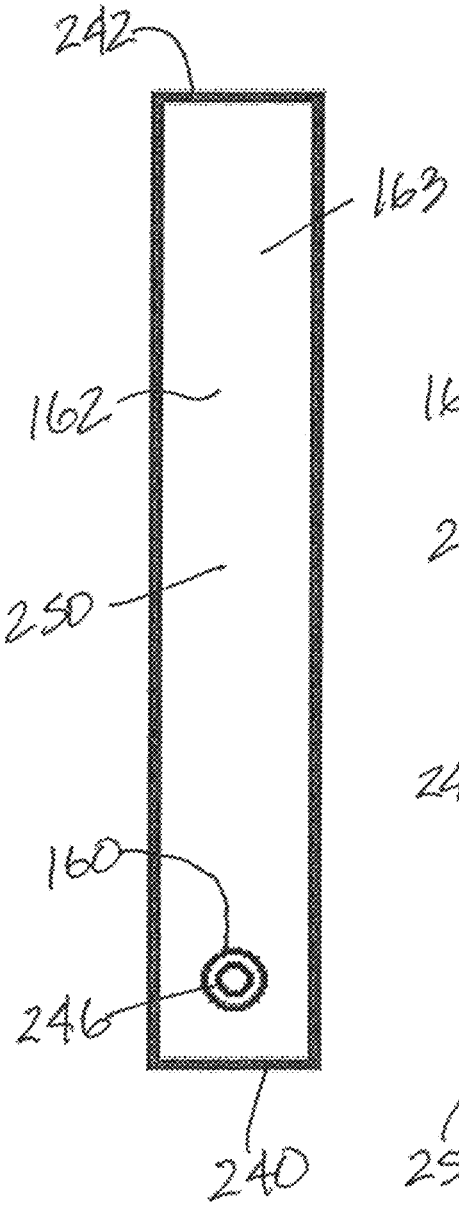
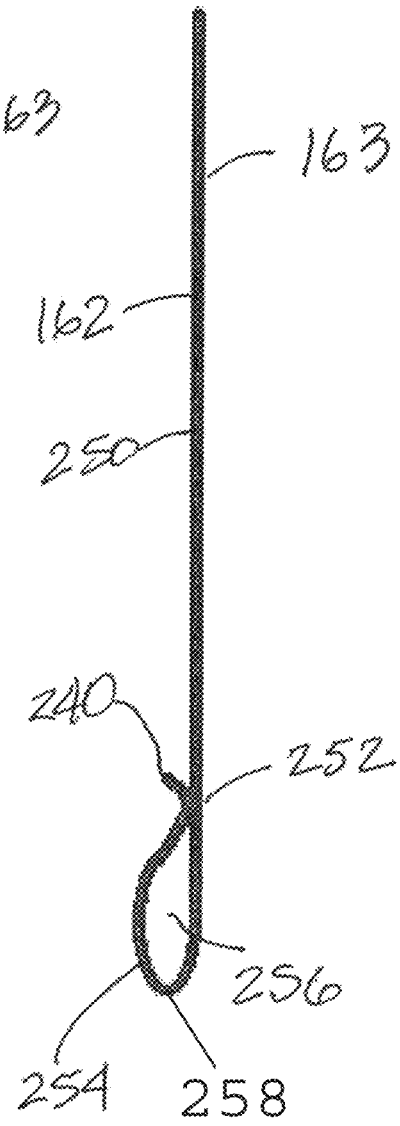
FIG. 7
FIG. 9

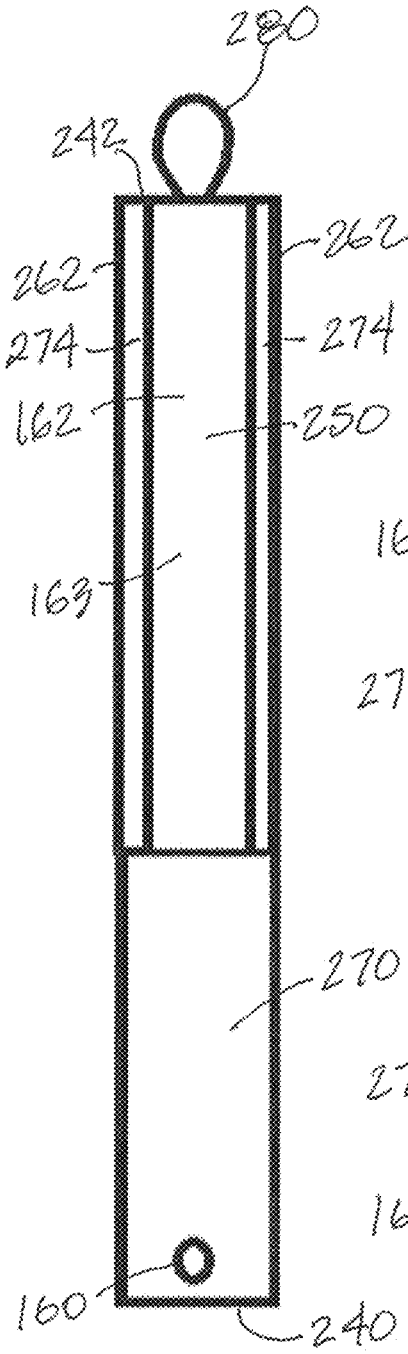
FIG. 10
FIG. 11
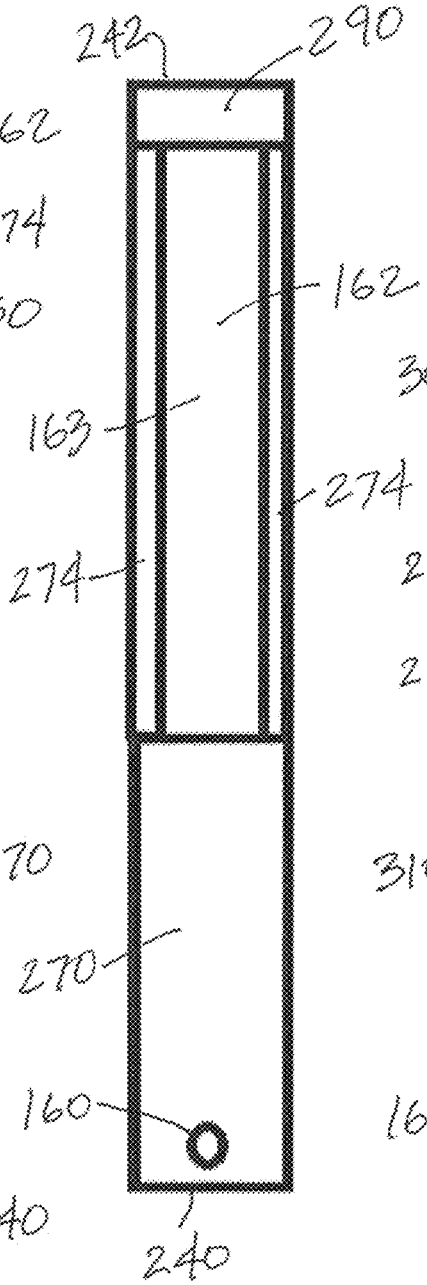
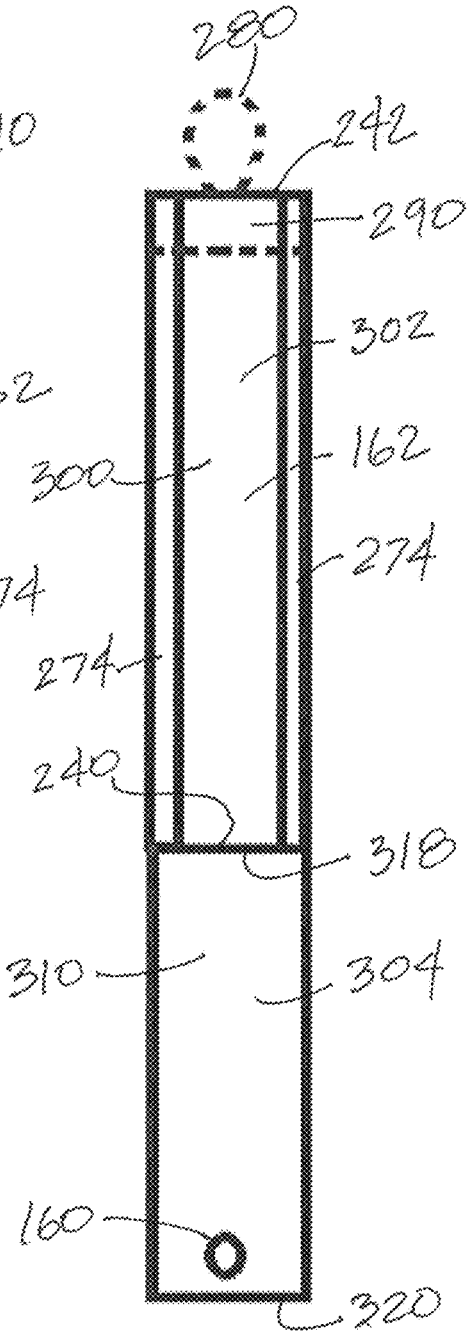
FIG. 12

LACES WITH TYING MECHANISMS AND RELATED METHODS

CROSS-REFERENCE TO RELATED APPLICATION

This is a continuation application of co-pending U.S. application Ser. No. 17/733,596, filed Apr. 29, 2022, the contents of which are expressly incorporated herein by reference.

FIELD OF ART

The present invention is generally directed to laces, such as shoe laces or shoes strings, to boxing glove laces, applications thereof, and to laces with tying mechanisms and related methods.

BACKGROUND

Tying shoe laces is a part of life that everyone learns to master. It is a simple and trivial enough task that few people ever stop to contemplate its integral part of everyday life. However, when an individual has physical limitations, limited dexterity, or limited mobility, tying shoe laces for a pair of shoes can be challenging.

Another similar scenario is the use of boxing gloves. When a boxer puts on a pair of gloves, her fingers are covered and her dexterity and mobility to tie her own gloves are impaired. Thus, in a boxing environment, a boxer typically requires another person to assist in tying the boxer's gloves. Once tied, the ends of each lace are typically taped to the cuff part of the respective boxing glove to prevent unwanted untying of the loose ends.

SUMMARY

Aspects of the present invention include a boxing glove, said boxing glove comprising: a body with a finger portion, a palm portion, a thumb portion, and a base portion having an opening for placement of a hand inside an interior of the body; a plurality of eyelets or openings having a lace passing through at least a subset of the eyelets or openings, said lace comprising two overhang lace sections and two free ends; and a fastener element having a body and wherein the two overhang lace sections are attached to the body of the fastener element.

The fastener element can be a back-to-back hook and loop element.

The fastener element can be a hook element and a separate loop element.

The terms hook element and loop element are understood to be two elements of a fastener system wherein the hook element and the loop element can engage to function as a fastener or a securement device.

A strip of a hook element can be referred to its shorthand version as simply a hook element.

A strip of a loop element can be referred to its shorthand version as simply a loop element.

A cover element having a protective surface can attach to the fastener element.

At least one edge liner can attach to an edge of the fastener element.

A gripper element can attach to an end of the fastener element.

The fastener element can have a first section attached to a second section and the second section attached to a third section, and wherein the second section can be made from a stretchable material.

The first section can comprise a hook element and the third section can comprise a loop element.

A gripper element or a gripper pad can attach to the first section and an eyelet can be located at the third section.

The fastener element can have an overall length of between 8 inches to 24 inches.

Aspects of the present invention further include a method for lacing up a boxing glove. The method can comprise: placing a hand through an interior of the boxing glove; pulling on the lace to create tension on the lace, said lace comprising at least one overhang lace section attached to a fastener element; wrapping the lace and the fastener element around a base portion of the boxing glove; and securing the lace without a knot on the at least one overhang lace section.

A further aspect of the invention is a method for lacing up a boxing glove comprising: placing a hand through an interior of the boxing glove; pulling on the lace to create tension on the lace, said lace comprising two overhang lace sections attached to back-to-back hook and loop element comprising an opening; wrapping the lace and the back-to-back hook and loop element around a base portion of the boxing glove; and securing the lace without by engaging the hook and the loop at the base portion.

A further aspect of the present invention includes a fastener element for use with a lace having two overhang lace sections comprising: a body having a length and a width made from a hook element, a loop element, or a back to back hook and loop element; a cover element attached to the body, the cover element having a softer surface than a hook element of a hook and loop system; and a hole formed through the cover element for receiving at least part of a lace.

The body can have a first edge and a second edge and wherein the cover element can attach at or near the first edge or the second edge.

The body can have a side edge and wherein an edge liner can attach to the side edge.

A stretchable intermediate piece can be located between the hook element and the loop element.

A still further aspect of the present invention can include a method for lacing up a boxing glove comprising: placing a hand through an interior of the boxing glove; pulling on a lace to create tension on the lace, said lace comprising at least one overhang lace section attached to a fastener element; wrapping the lace and the fastener element around a base portion of the boxing glove; and securing the lace and maintaining the tension by securing a first portion of the fastener to a second portion of the fastener element.

The first portion of the fastener element can attach to an intermediate piece and the second portion of the fastener element can attach to the intermediate piece.

The at least one overhang lace section can project through an eyelet located with the second portion and a second overhang lace section projects through the eyelet.

The first portion of the fastener element can comprise a hook element and a backing and the second portion of the fastener element can comprise a loop element and a cover element.

The intermediate piece can be made from a stretchable material.

The method can further comprise the step of grasping a second fastener element secured to a second boxing glove using the hand located inside a first boxing glove.

Methods of making and of using the fastener elements and components thereof of the present disclosure are within the scope of the present invention.

Fastener elements of the present invention can be used with laces found in shoes and boxing gloves, among others. A pair of boxing gloves can include a right handed boxing glove and a left handed boxing glove. The boxing gloves can be any number of commercially available boxing gloves and can include sparing gloves, bagging gloves, and competing gloves.

A typical boxing glove comprises a body, such as a glove body, with a finger portion, a palm portion, a thumb portion, a wrist portion, and an opening portion, which has an opening or inlet for inserting a boxer's hand into the interior of the glove body. Together, the wrist portion and the opening portion can be called a base portion.

In an example, the base portion can have an elongated slit or channel defined by two flaps with each flap having a plurality of eyelets. A tongue can be provided between the two flaps to provide a barrier between the flaps and the skin.

The eyelets can simply be small holes or openings formed through the material of the two flaps and usable for threading a lace or a string therethrough to retain the two flaps together. In other examples, the eyelets can be reinforced metal eyelets and can each comprise small metal pieces to reinforce a corresponding opening on the two flaps.

Grommets are similar to reinforced metal eyelets but typically used for more heavy duty material. Unless the context indicates otherwise, a lace and a string can be used synonymously, a slit and a channel at the base portion can be used synonymously, and an eyelet and a grommet can be used synonymously. An eyelet as used herein can be a small opening or an opening reinforced by one or more metal pieces to produce a reinforced opening.

Further, the terms first and second and left and right are used as reference points only and not structurally limiting unless the context indicates otherwise. For example, an object can have a first end and a second end and the reference "first" and "second" identified for reference purposes to describe aspects of the object. The only restriction is that once an end has been called or selected to be a "first" end, then the same end cannot also be a "second" end. Similar to the terms left and right and up and down.

A single lace can pass through the plurality of eyelets in a typical crossing pattern. In other examples, the stringing pattern or lacing pattern can be different, such as a knotted lacing pattern, a ladder lacing pattern, a hash lacing pattern, a diagonal lacing pattern, a bow tie lacing pattern, or a straight lace pattern. In still other examples, more than one lace can be used to lace through the eyelets.

A typical lace can have a length that is sufficient to lace through the eyelets of the two flaps of a boxing glove, or a shoe, and extend beyond the last eyelet of each flap with two overhang lace sections. Each overhang lace section has a terminal end or free end with a reinforced tip, which is typically reinforced by tape, plastic coating, or similar elements. The two free ends can remain free prior to coupling to a fastener element or can be tied or connected to one another prior to coupling to the fastener element.

The lace should be long enough so that the two overhang lace sections can wrap at least partially around the base portion of the glove. In some examples, the two overhang lace sections can wrap around at least one full revolution around the base portion of the boxing glove, such as 1 to 1.2 revolutions, 1.5 revolutions, 2 revolutions, or a higher number of revolutions.

In an example, the two overhang lace sections are passed through an opening or through hole of the anchoring mechanism or fastener element. In alternative embodiments, two or more openings are provided with the fastener element for looping the two overhang lace section therethrough to secure the lace to the fastener element. Each overhang section can loop through a respective opening of the multiple openings fastener element, when two or more openings are incorporated, or in any pattern or method desired by the user for purposes of tying the lace to the fastener element.

In an example, a back-to-back hook and loop element can form the basis of the fastener element, for example a VELCRO® brand hook and loop length. A hook and loop element having a length of about 8 inches to about 24 inches may be used with the lace with other dimensions contemplated, such as being shorter than 8 inches or longer than 24 inches.

The hook and loop width can be about ¾ inch to about 1.5 inches with other dimensions contemplated, such as being less than ¾ inch or greater than 1.5 inches. A back-to-back hook and loop system forming the fastener element of the present disclosure has the hook on one side or face of a strip and the loop on the other side or face of the strip of the fastener system. The hook is understood to be the rougher of the hook/loop fastening system, and the loop the softer of the two materials.

The hole on the fastener element can be reinforced, such as with a metal eyelet. In other examples, there can be two or more holes formed through the fastener element so as to distribute the pulling forces over larger areas of the fastener element.

In use, a boxer, or a person that plans to wear the boxing gloves can place his or her hand in through the opening portion of the glove and into the interior of the body and then pull on the two overhang lace sections of the lace to pull the two flaps together so as to tighten the base portion around the boxer's wrist and forearm.

The boxer can then wrap the overhang lace sections around the base portion of the glove while maintaining a firm grip on the lace so as to hold the lace in tension around the base portion. Once the two overhang lace sections are taken up by the partial, full, or greater than one wrapping revolution around the base portion, the boxer can then continue to wrap the hook and loop system of the fastener element around the base portion of the glove until the hook and the loop of the fastener element can engage one another.

The lace can be tightened around the glove when the fastener element attaches to itself to maintain the lace in the wrapped position. The engagement between the hook and loop of the fastener element keeps the lace tightly wrapped around the base portion of the glove without the need for a second person. Different fastener elements as described elsewhere herein can be used in the manner described.

After the boxer successfully secures the lace of the first boxing glove as described herein, the boxer can now place his or her left hand into the second boxing glove and repeat the securing steps. Because no special dexterity is required to take up the tension of the lace and maintain the tension, as the lace is not required to be tied or knotted to maintain the tension around the base section, the boxer can repeat the securing steps by gripping the lace and/or the fastener element on the second boxing glove using the thumb portion and the finger/palm portions of the first boxing glove, with the left or right hand located therein, to secure the lace of the second boxing glove with the other hand located in the second boxing glove.

The boxer can start with either hand. Thus, the first boxing glove can be a right-handed boxing glove or a left-handed boxing glove and the second boxing glove can be the other one of the right-handed boxing glove or the left-handed boxing glove.

Once completed, the boxer is able to put on both the left and right handed boxing gloves by himself or herself without the aid of a second person to tie or knot the ends of the lace together, which is impossible to do without the aid of the lace and fastener element of the present embodiments.

Although the description refers to placement of the right hand into the right handed boxing glove first and then follow by the left hand into the left handed glove, the invention can be practiced in reverse, starting with the left hand and then the right hand.

An opening can be formed with a puncher to create a hole near a first end of a fastener element, opposite a second end of the fastener element. The fastener element can be formed with a back to back hook and loop element or the body can be formed by attaching a strip of hook element to a strip of a loop element, in an end-to-end or serial configuration, with or without an intermediate piece therebetween.

The opening or through hole can be reinforced with a metal eyelet.

The first end of the fastener element can be wrapped around and attached to the body of the fastener element at an attached point, such as with stitching, sewing, bonding, and/or adhesive. This wrapped section in combination with the attached point can form a body loop near the first end of the fastener element.

Two free ends of a lace can pass through the body loop and then tied off to mechanically secure the lace to the fastener element. The fastener element of the present disclosure can be formed with a back to back hook and loop element or the body can be formed by attaching a strip of hook element to a strip of a loop element, in an end-to-end or serial configuration, with or without an intermediate piece therebetween.

In some examples, a lace can be laced through a plurality of eyelets on a shoe or a boxing glove differently than as shown and described herein and is still usable with a fastener element of the present invention. For example, the lace can be laced so that there is only one lace overhang and the one lace overhang connected to the fastener element described elsewhere herein.

In still other examples, the lace can have a different lacing pattern than the crossing pattern shown. In still other examples, after lacing a boxing glove or a shoe as described elsewhere herein, tape can be used to further secure the fastener element from inadvertently coming loose or coming undone.

A cover element can attach to the body of the fastener element, such as by stitching, sewing, adhesive, welding, or combinations thereof. The cover element can be attached closer to the first end of the body than the second end of the body. An opening can be provided through both the cover element and the body of the fastener element to receive one or two free ends of a lace. A reinforced metal eyelet can be included with the opening.

The cover element can function as a smooth protective layer or surface and can embody any number of materials, including VELCRO compatible neoprene, neoprene, closed cell foam, polyester tricot loop, nylon knitted loop, nylon tricot, low pile loop fabric, unbroken loop fabric, Spandex and nylon jersey, Spandex and polyester Perfectex, Lycra fabric, heavy duty cotton, low density ethylene foam, and polyethylene foam. The cover element is understood to have a relatively softer surface than that of the hook element and softer than the edges of the hook element or loop element.

The cover element can be incorporated so that when the lace and fastener element are wrapped around an object, such as around an extended ankle support system of a shoe or around a base portion of a boxing glove, the cover element does not scratch or otherwise damage the surfaces that the cover element comes into contact.

The cover element can have a width that matches or closely corresponds to the width of the body of the fastener element. The length of the cover element can be selected so that some or all of the circumference to which the fastener element wraps around, such as the base portion of a boxing glove, contacts the cover element. In an example, the cover element is attached to the hook side of a back-to-back hook and loop element, such as by stitching, sewing, bonding, adhesive, or combinations thereof.

The present fastener element can include two edge liners, one on each side edge of the fastener element. Each edge liner can be a woven or non-woven cloth or fabric and can be attached to the respective side of the body by sewing, stitching, adhesive, bonding, or combinations thereof. In other examples, the two edge liners can be made from a thermoplastic foam material. The two edge liners can protect a user or wearer from the relatively hard surface of the edges of the body to prevent unwanted injuries or pain.

The two edge liners can extend the remaining length of the body along the two edges not covered by the cover element or can extend the full length of the fastener element or any length in between. In an example, the two edge liners can be made from a polyester fabric or material.

Optionally, a gripper element may be included at or near the second end of the body. The gripper element can be attached to the loop side of the fastener element so as to leave the hook side of the fastener element exposed at the second end for securing against the loop element when the fastener element is wrapped around an object, such as around the base of a boxing glove. When incorporated, the gripper element provides a leverage point to facilitating separating the hook element from the loop element.

The gripper element, when incorporated, can embody a loop with a hole or opening in the middle thereof. In other examples, the gripper element is an enlarged gripping structure or fabric for grabbing and pulling, with or without a loop. The gripper element can be made from any number of materials, including from a woven or non-woven strip of fabric or cloth or from a string. In an example, the gripper element is made from a polyester material.

A gripper pad can alternatively be provided at the second end of the gripper element. In an example, the gripper pad is stitched, sewn, bonded, or glued to the body, including to the hook side of the fastener element. The gripper pad, which can have the same material as the cover element or the edge liners or be made from a different material, can be used by the user or wearer to pry the hook from the loop of the fastener element to separate the fastener element from the object, such as from the boxing glove or shoe.

The overall length of the fastener element can be made from at least two distinct materials or sections. The first section can be made from a hook element having a first end and a second end. Optionally, the first section can be a back-to-back hook/loop element. The second section can be made from a loop element with a built-in loop that is compatible with the hook element of the first section or from a loop element. For example, the loop element can be a VELCRO hook/loop system, neoprene, polyester tricot loop, nylon knitted loop, low pile loop fabric, unbroken loop fabric, etc.

The second section can have a first end attached to the first end of the first section and a second end spaced from the first end. The first end of the first section and the first end of the second section can overlap and the stitching or sewing performed at the overlapped sections. The opening, which can be reinforced with a metal eyelet, is located closer to the second end than to the first end of the loop element. For simplicity, the first section can be considered a hook element and the second section can be considered a loop element.

A cover element, similar to those shown and described elsewhere, can be attached to the second section to provide cushion, padding, or coverage upon contact with the shoe or boxing glove.

The first section of the fastener element may incorporate a gripper element or a gripper pad. Optionally, the gripper element and/or the gripper pad can be omitted. The first section and the second section may attach to one another by stitching, sewing, bonding, adhesive or combinations thereof.

Thus, a fastener element described herein can have an overall length defined by a hook element, a loop element, or a combination hook/loop element. Optionally, an intermediate piece can be provided between a strip of a hook element and a strip of a loop element. The intermediate piece can be a stretchable material, an elastic belt, or a fabric. In other examples, the overall length of a fastener element can be defined by two or more distinct sections. For example, a length of the fastener element can be a loop element and another length of the fastener element can be a hook element, a loop element, or a combination hook/loop element.

A further aspect of the present invention includes a fastener element made from a first section attached to a second section, which is then attached to a third section. The first section can overlap with the second section at a first overlapped region. The first section and the second section can be secured together at the first overlapped region by stitching, sewing, bonding, adhesive or combinations thereof.

The second section can overlap with the third section at a second overlapped region. The first section and the second section can be secured together at the second overlapped region by stitching, sewing, bonding, adhesive or combinations thereof.

The fastener element can have a body defined by the three sections. The body can have a first end and a second end.

An opening can be provided with the body near the first end. The opening can be a simple hole punched through the third section or can be reinforced with a metal eyelet.

A gripper element or a gripper pad can be provided and attached to the second end of the body. In an example, the body is provided with a gripper pad, which can overlap with the first section at a third overlapped region. The first section and the gripper element or gripper pad can be secured together at the third overlapped region by stitching, sewing, bonding, adhesive or combinations thereof.

The first section of the fastener element can be made from a strip of a hook element for attaching to a loop element. The length of the first section can be about 3 inches to about 11 inches in length. The hook element can optionally be provided with a backing material. The backing material can attach to the hook element around a perimeter of the hook element, such as by stitching, sewing, bonding, adhesive, or combinations thereof.

In an example, the backing material can be made from a synthetic textile such as a from a nylon material, a polyester material or from Nomex. Optionally, the backing material can be made from heavy duty cotton. In some examples, the exterior surface of the backing material can be printed or labeled with any number of information, such as manufacturer information, team logo, personalized prints, etc. When the fastener element is put to use, the exterior surface and the optional printed information can be exposed and visually detectable.

In an example, the second section can have a structure or body that is stretchable. For example, the second section can be made from a stretchable material, an elastic belt, from Lycra, from Spandex, from Nylon Lycra fabric, or similar two dimensional or four dimensional stretchable fabrics. The second section, which can also be referred to as an intermediate piece, can have a length of between about 1.5 inches to about 6 inches.

In some examples, there can be more than one strip of stretchable material used for the second section. For example, there can be two or more overlapping strips, or a long strip that is folded, to provide bulk and greater biasing force than a single strip of the same construction.

The third section can have two side edges with each of the two side edges having an edge liner attached thereto. The third section can include a trip of a loop element and a cover element. The cover element is similar to cover elements described elsewhere herein.

A through hole or eyelet, which can be a punched hole or a metal reinforced eyelet, can be provided near an end of the third section. Overhang lace sections of a lace can project through the eyelet and secured thereto by knotting. In some examples, there can be two or more eyelets for coupling with the overhang lace sections.

The hook element can orient in a first direction while the loop element oriented in a second direction, opposite the first direction. This arrangement allows the fastener element to wrap around an object, such as a boxing glove, with the cover element in contact with the object so that the loop element is exposed for engagement by the hook element. The length of the third section can be approximately 6 inches to about 14 inches.

In an example, the second section or intermediate piece projects between the cover element and the loop element of the third piece and then secured between the two by stitching, sewing, bonding, adhesive or combinations thereof. In other examples, the intermediate piece can lie over or under the third section and not between the cover element and the loop element of the third piece.

The fastener elements described herein can be viewed as having a first portion configured for attaching to a second portion of the fastener element. The first portion of the fastener element can attach to an intermediate piece and the second portion of the fastener element can attach to the intermediate piece. The first portion and the second portion can attach to one another through the intermediate piece.

The intermediate piece can comprise a single element or a single body or more than one element having multiple separate pieces that are attached together. The first portion and the second portion are indirectly attached to one another. Optionally, the first portion and the second portion are directly attached to one another and the intermediate piece is omitted.

A further aspect of the invention includes a boxing glove, said boxing glove comprising: a body with a finger portion, a palm portion, a thumb portion, and a base portion; the base portion having an opening portion and a slit located between a first flap and a second flap, said opening portion is configured to receive a hand and said slit defining a lengthwise axis; the first flap having a column of eyelets and the second flap having a column of eyelets and the eyelets of the two columns aligned to define a plurality of eyelet rows; a tightening mechanism having a fastener element and at least one lace having two free ends including a first free end and a second free end, said fastener element having a through hole; wherein the at least one lace is passed through the through hole of the fastener element and the two free ends are secured to the base portion at the first flap or the second flap; and wherein an apex connects a first lace section and a second lace section of the at least one lace and the first lace section and the second lace pass through two different eyelets of the first flap, the second flap, or both the first flap and the second flap.

A still yet further aspect of the invention includes a method for lacing and tightening a boxing glove comprising: placing a hand through an interior of the boxing glove; passing a lace through a through hole of a fastener element; passing a first free end of the lace through a first eyelet on a base portion of the boxing glove and passing a second free end of the lace through a second eyelet on the base portion of the boxing glove; securing the first free end and the second free end of the lace to the base portion to create an apex between a first lace section and a second lace section of the first lace; pulling the fastener element in a first direction radial to a lengthwise axis defined by a gap on the base section and wrapping the lace and the fastener element around the base portion of the boxing glove.

A yet further aspect of the invention includes a boxing glove, said boxing glove comprising: a body with a finger portion, a palm portion, a thumb portion, and a base portion; the base portion having a slit located between a first flap and a second flap; each of the first flap and the second flap having a column of eyelets and the eyelets from the two columns aligned to define a plurality of eyelet rows; a tightening mechanism having a fastener element, a lace, and at least one locking mechanism, said fastener element having through hole; and wherein the lace passes through the through hole of the fastener element and a first free end, a second free end, or both the first and second free ends of the lace are secured to the at least one locking mechanism.

BRIEF DESCRIPTION OF THE DRAWINGS

These and other features and advantages of the present devices, systems, and methods will become appreciated as the same becomes better understood with reference to the specification, claims and appended drawings wherein:

FIGS. 7-9 are schematic depictions of different embodiments of a fastener element.

FIGS. 10-12 are schematic depictions of further alternative embodiments of a fastener element.

DETAILED DESCRIPTION

The detailed description set forth below in connection with the appended drawings is intended as a description of the presently preferred embodiments of laces with tying mechanisms, and said laces in combination with shoes or boxing gloves provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
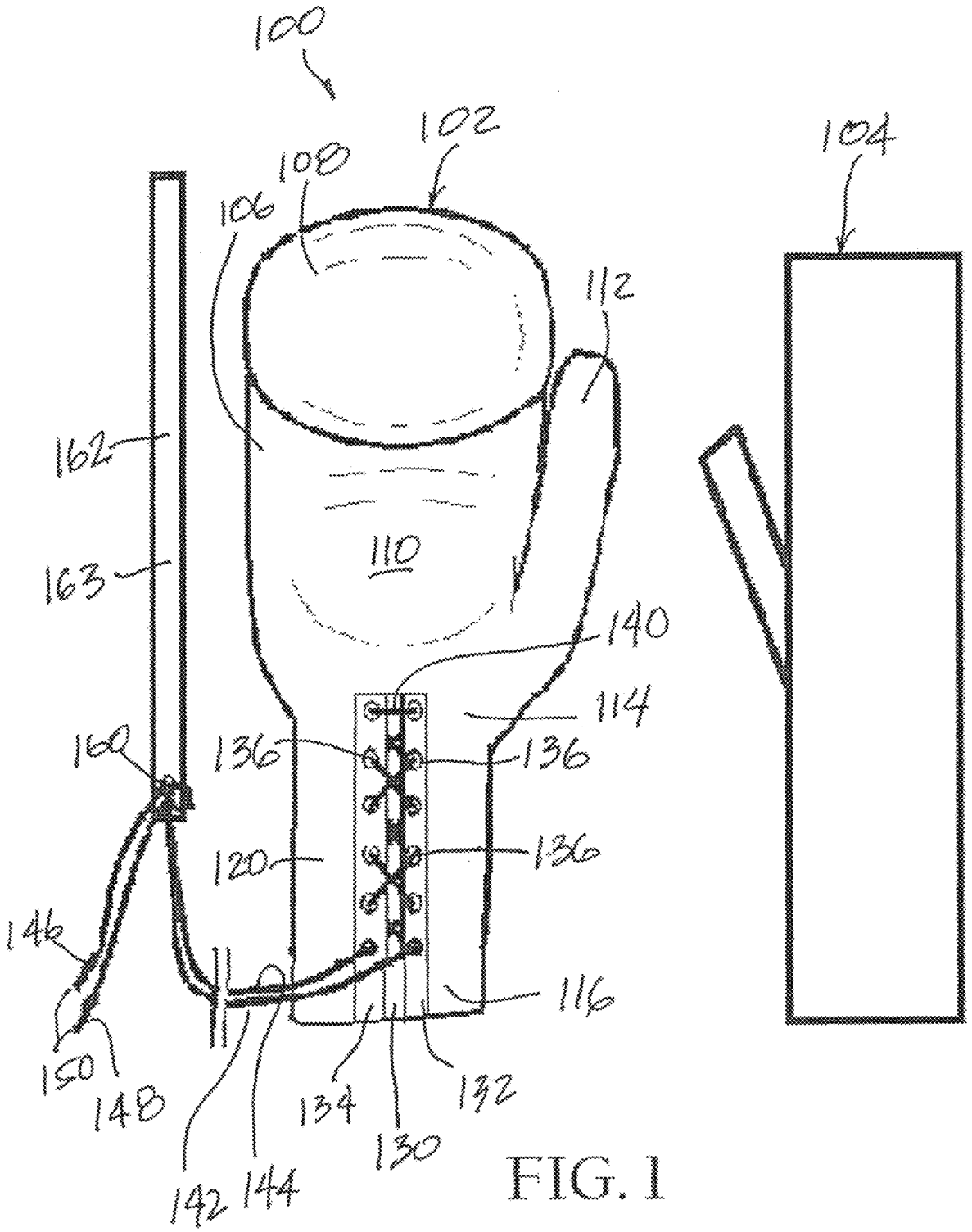
FIG. 1 is a schematic depiction of a boxing glove with a lace attached to a tying mechanism.

With reference now to FIG. 1, a pair of boxing gloves 100 are shown, which includes a right handed boxing glove 102 and a left handed boxing glove 104, the latter being shown schematically only. The boxing gloves 102, 104 can be any number of commercially available boxing gloves and can include sparing gloves, bagging gloves, and competing gloves. Further discussions below will be directed to the right handed glove 102 shown only, which are understood to apply equally to the left handed glove 104.

The boxing glove 102 comprises a body 106, such as a glove body, with a finger portion 108, a palm portion 110, a thumb portion 112, a wrist portion 114, and an opening portion 116, which has an opening or inlet for inserting a boxer's right hand into the interior of the glove body. Together, the wrist portion 114 and the opening portion 116 can be called a base portion 120. In an example, the base portion 120 has an elongated slit or channel 130 defined by two flaps 132, 134 with each flap having a plurality of eyelets 136. A tongue can be provided between the two flaps 132, 134 to provide a barrier between the flaps and the skin.

The eyelets shown can simply be small holes or openings formed through the material of the two flaps 132, 134 and usable for threading a lace or a string therethrough to retain the two flaps 132, 134 together. In other examples, the eyelets can be reinforced metal eyelets and can each comprise small metal pieces to reinforce a corresponding opening on the two flaps 132, 134. Grommets are similar to reinforced metal eyelets but typically used for more heavy duty material. Unless the context indicates otherwise, a lace and a string can be used synonymously, a slit and a channel at the base portion can be used synonymously, and an eyelet and a grommet can be used synonymously. An eyelet as used herein can be a small opening or an opening reinforced by one or more metal pieces to produce a reinforced opening.

A single lace 140 is shown in FIG. 1 laced through the plurality of eyelets 136 in a typical crossing pattern. In other examples, the stringing pattern or lacing pattern can be different, such as a knotted lacing pattern, a ladder lacing pattern, a hash lacing pattern, a diagonal lacing pattern, a bow tie lacing pattern, or a straight lace pattern. In still other examples, more than one lace 140 can be used to lace through the eyelets 136. The lace 140 has a length that is sufficient to lace through the eyelets 136 of the two flaps 132, 134 and extend beyond the last eyelet of each flap with two overhang lace sections 142, 144. Each overhang lace section has a terminal end or free end 146 or 148 with a reinforced tip 150, which is typically reinforced by tape, plastic coating, or similar elements. The two free ends 146, 148 can remain free prior to coupling to a fastener element 162 or can be tied or connected to one another prior to coupling to the fastener element 162.

The lace 140 should be long enough so that the two overhang lace sections 142, 144 can wrap at least partially around the base portion 120 of the glove 102. In some examples, the two overhang lace sections 142, 144 can wrap around at least one full revolution around the base portion 120 of the boxing glove, such as 1 to 1.2 revolutions, 1.5 revolutions, 2 revolutions, or a higher number of revolutions.

In an example, the two overhang lace sections 142, 144 are passed through an opening or through hole 160 of the anchoring mechanism or fastener element 162. In alternative embodiments, two or more openings 160 are provided with the fastener element 162 for looping the two overhang lace sections 142, 144 therethrough to secure the lace 140 to the fastener element 162. Each overhang section 142, 144 can loop through a respective opening of the multiple openings 160 fastener element, when two or more openings are incorporated, or in any pattern or method desired by the user for purposes of tying the lace 140 to the fastener element 162.

In an example, a back-to-back hook and loop element 163 can form the basis of the fastener element, for example a VELCRO® brand hook and loop length. A hook and loop element 163 having a length of about 8 inches to about 24 inches may be used with the lace 140 with other dimensions contemplated, such as being shorter than 8 inches or longer than 24 inches. The hook and loop width can be about ¾ inch to about 1.5 inches with other dimensions contemplated, such as being less than ¾ inch or greater than 1.5 inches. A back-to-back hook and loop system 163 forming the fastener element 162 of the present disclosure has the hook on one side or face of a strip and the loop on the other side or face of the strip of the fastener system. The hook is understood to be the rougher of the hook/loop fastening system, and the loop the softer of the two materials. The hole 160 on the fastener element 162 can be reinforced, such as with a metal eyelet. In other examples, there can be two or more holes 160 formed through the fastener element 162 so as to distribute the pulling forces over larger areas of the fastener element 162.

Figure 2:
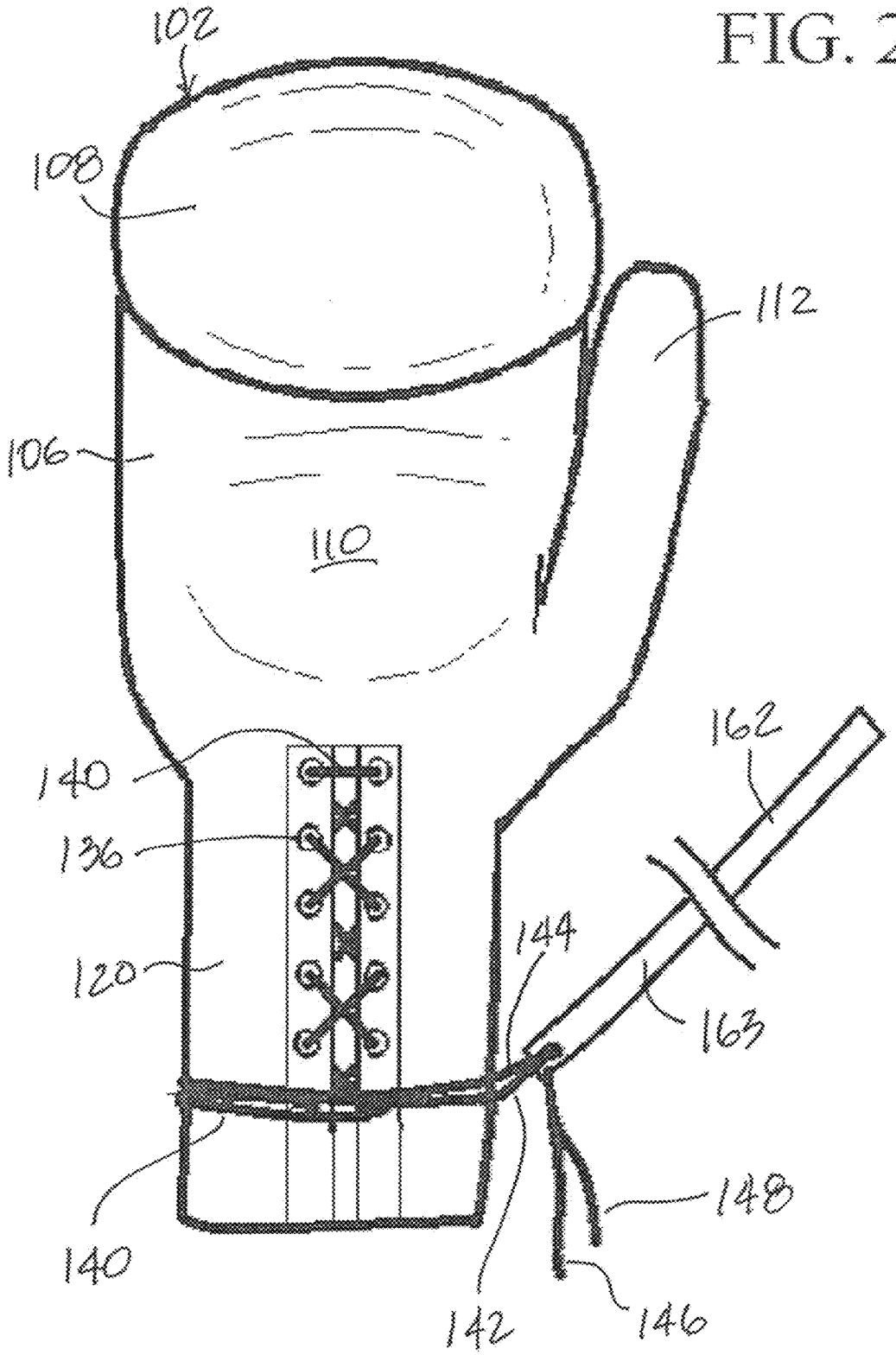
FIG. 2 is a schematic depiction of the boxing glove of FIG. 1 with the lace wrapped around the base portion of the boxing glove.
Figure 3:
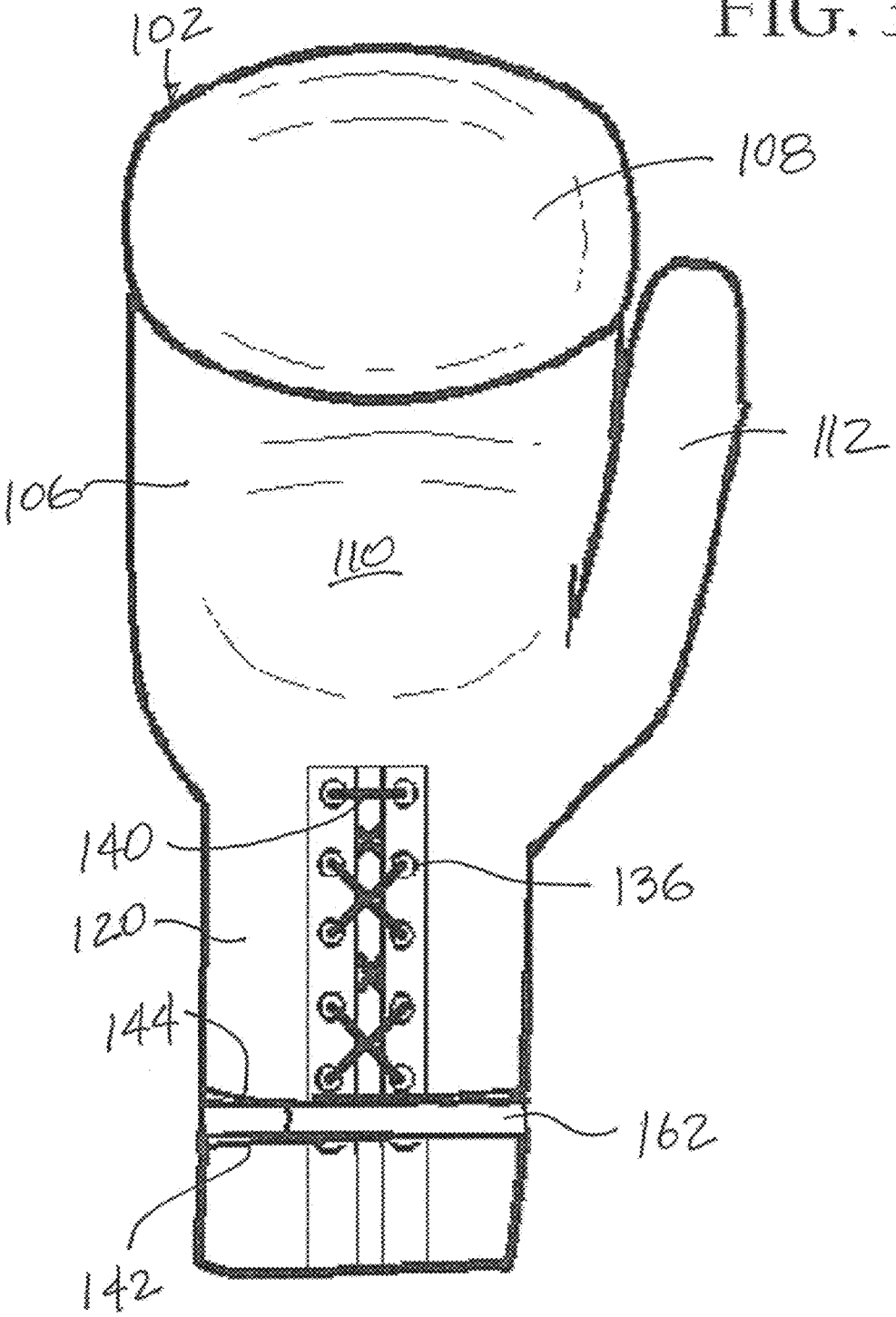
FIG. 3 is a schematic depiction of the boxing glove of FIG. 1 with the lace wrapped around the base portion of the boxing glove and the tying mechanism wrapped around the base portion of the boxing glove.

In use, a boxer, or a person that plans to wear the boxing gloves 100, places his or her right hand in through the opening portion 116 of the right handed glove 102 and into the interior of the body 106 and then pull on the two overhang lace sections 142, 144 of the lace 140 to pull the two flaps 132, 134 together so as to tighten the base portion 120 around the boxer's wrist and forearm. With further reference to FIG. 2 in addition to FIG. 1, the boxer then wraps the overhang lace sections 142, 144 around the base portion 120 of the glove 102 while maintaining a firm grip on the lace 140 so as to hold the lace in tension around the base portion 120. Once the two overhang lace sections 142, 144 are taken up by the partial, full, or greater than one wrapping revolution around the base portion, the boxer then continues to wrap the hook and loop system 163 of the fastener element 162 around the base portion 120 of the glove until the hook and the loop of the fastener element 162 can engage one another. The lace 140 is now tightened around the glove 102 as shown in FIG. 3 and the fastener element 162 activated to maintain the lace in the wrapped position. The engagement between the hook and loop of the fastener element 162 keeps the lace 140 tightly wrapped around the base portion 120 of the glove 120 without the need for a second person.

With reference again to FIG. 1, after the boxer successfully places the right handed glove 102 over the right hand, or the right hand into the right handed glove, and secures the lace 140 as described herein, the boxer can now place his or her left hand into the left handed boxing glove 104 (shown schematically in FIG. 1) and repeat the securing steps. Because no special dexterity is required to take up the tension of the lace and maintain the tension, as the lace is not required to be tied or knotted to maintain the tension around the base section 120, the boxer can repeat the securing steps by gripping the lace 140 and/or the fastener element 162 on the left handed glove 104 between the thumb portion 112 and the finger/palm portions of the right hand while the hand is located inside the right handed boxing glove 102 to secure the lace 140 of the left handed boxing glove 104 over the left hand. Once completed, the boxer is able to put on both the left and right handed boxing gloves by himself or herself without the aid of a second person to tie or knot the ends of the lace together, which is impossible to do without the aid of the lace and fastener element of the present embodiments.

Although the description refers to placement of the right hand into the right handed boxing glove first and then follow by the left hand into the left handed glove, the invention can be practiced in reverse, starting with the left hand and then the right hand.

Figure 4:
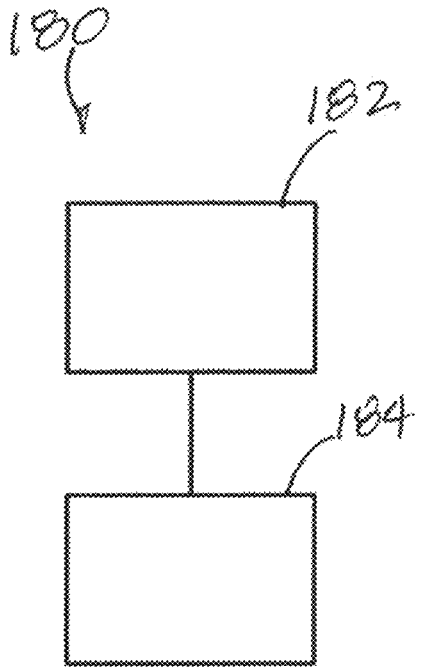
FIG. 4 is a process flow diagram for practicing tying or securing of a lace in accordance with aspects the present invention.

With reference now to FIG. 4, a process flow diagram or a diagram depicting method steps for practicing aspects of the present invention is shown, which is generally designated 180. The process 180 of FIG. 4 includes placing two overhang lace sections of a lace of a left handed boxing glove in mechanical connection or securement with a fastener element at 182. The fastener element 162 can comprise a back-to-back hook and loop element 163. Alternatively, the fastener element 162 can comprise a loop element and a hook element placed in contact with one another, which can be directly or indirectly in contact with one another. For example, one end of a strip having the hoop element can attach to an end of a strip having the hook element using conventional means, such as by sewing, stitching, gluing, or combinations thereof.

In another example, an intermediate piece can be placed between the strip having the loop element and the strip having the hook element. In an example, the intermediate piece located between the two strips can be any number of fabrics, belt, or cloth material. In a particular example, the intermediate piece located between the two strips can be a stretchable material, an elastic belt, or a fabric. The intermediate piece can have a first end and a second end. The strip with the loop element can be attached to the first end of the intermediate piece and the strip with the hook element can be attached to the second end of the intermediate piece to join the pieces together. Sewing or stitching can be used to join or attach the two strips and the intermediate piece together with other alternatives contemplated, such as by gluing, bonding, or combinations thereof.

The process 180 further includes placing two overhang lace sections of a lace of a right handed boxing glove in mechanical connection or securement with a second fastener element at 184. The fastener element at step 184 can also be a back-to-back hook and loop element or can be a strip with the hook element attached to an end of a strip with the loop element, optionally with a connecting piece located therebetween. The process can reverse and start with the right handed boxing glove and then proceed to the left handed boxing glove.

In some examples, one overhang lace section of a lace is placed in mechanical connection or securement with a hook element while the other overhang lace section of the lace is placed in mechanical connection or securement with a loop element. This alternative process differs from using a back-to-back hook and loop element and produces a lace system with separate hook and loop elements.

Figure 5:
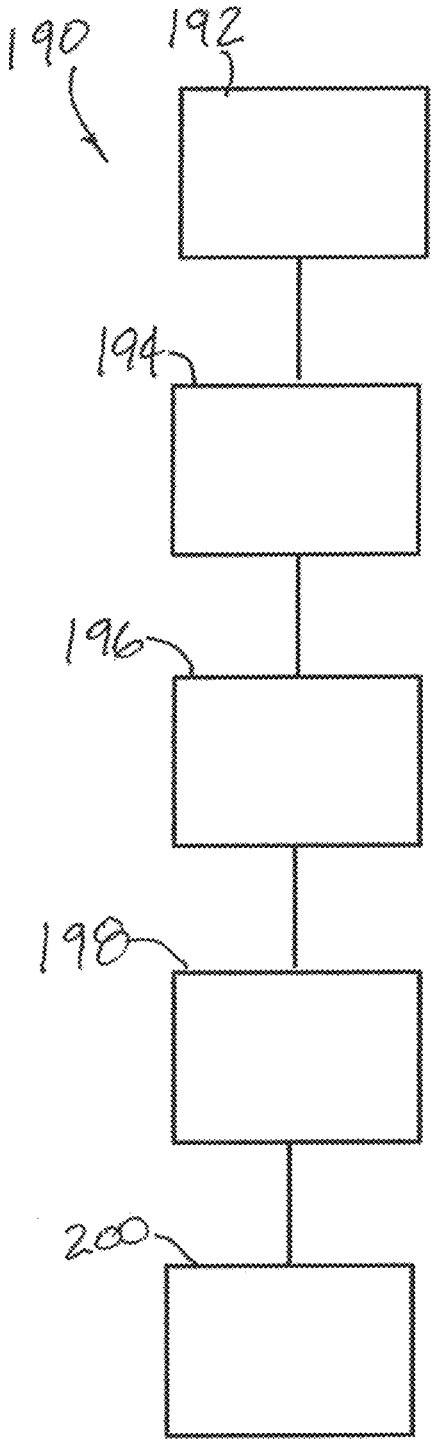
FIG. 5 is a process flow diagram for practicing tying or securing of a lace in accordance with further aspects of the present invention.

With reference now to FIG. 5, a further process flow diagram or a diagram depicting method steps for practicing aspects of the present invention is shown, which is generally designated 190. In an example, the process 190 includes first placing a left hand into a left handed boxing glove or a right hand into a right handed glove at 192, i.e., the first boxing glove, said boxing glove comprising a lace having two lace overhang sections attached to a fastener element, similar to one of the fastener elements 162 described elsewhere herein. The fastener element can be a back-to-back hook and loop fastener element, or a separate hook and loop element that are connected end-to-end to one another, either directly or indirectly with an intermediate piece therebetween.

At 194, the method includes wrapping the two lace overhang sections around the base portion of the boxing glove with the hand located inside and then continue to wrap around the base portion of the boxing glove so that the hook and loop element or elements of the boxing glove engage or secure to one another, as shown in FIGS. 1, 2, and 3 and as previously described. In some examples, the lace is pulled so that tension is maintain through at least part of the lace and the two flaps 132, 134 (FIG. 0.1) of the glove before securing the fastener element by attaching the hook element to the loop element.

At 196, the process further comprises placing the other one of the left hand or the right hand into the left handed boxing glove or the right handed glove, i.e., the second boxing glove, said boxing glove comprising a lace having two lace overhang sections attached to a fastener element, such as to a fastener element having a back-to-back hook and loop fastener element or a separate hook element connected to a loop element in an end-to-end arrangement, either directly or indirectly with an intermediate piece located therebetween. The process includes using the now secured hand inside the first boxing glove via steps 192 and 194 to grip a lace and/or a fastener element between the thumb portion and the finger/wrist portions of the boxing glove of the secured hand at 198.

At 200, the process further includes wrapping the two lace overhang sections of the second boxing glove around the base portion of the second boxing glove with the secured hand inside the first boxing glove while maintaining tension on the lace, or at least part of the lace. The process includes continuing wrapping the overhang sections of lace around the base portion so that the fastener element, such as a hook and loop element or separate hook and loop elements in an end-to-end arrangement, of the second boxing glove engage or secure to one another, as shown in FIGS. 1, 2, and 3 and as previously described. The steps provided by the process diagram 190 of FIG. 5 explains a unique and novel way for a boxer to place his or her hands into a left handed boxing glove and then a right handed boxing glove, or in the reverse, and then lace up the two boxing gloves without the assistance of another person.

Figure 6:
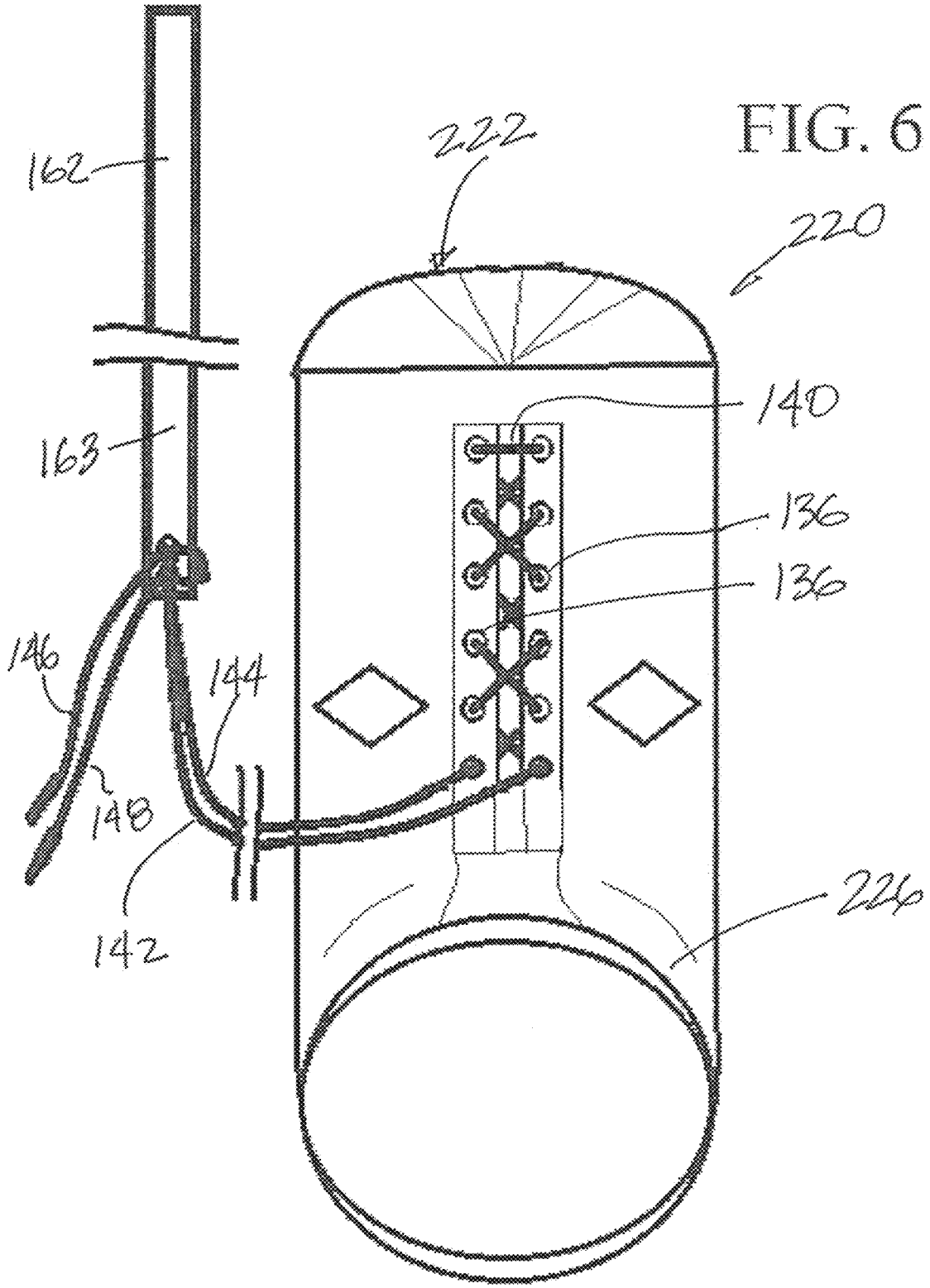
FIG. 6 is a schematic depiction of a pair of shoes (only one shown) with a lace attached to a tying mechanism.

FIG. 6 is a schematic depiction of a pair of shoes 220 (only one shown) having a lace 140 and an anchoring mechanism or fastener element 162 of the present invention, which can be a fastener element comprising a hook and loop element 163. In an example, the shoe 222, which can be a left shoe or a right shoe, can be a high-top shoe, a boot, a work boot, or a shoe that is other than a standard low-cut shoe and having a plurality of eyelets. The shoe can generically be called a high-top shoe and has an extended ankle support section 226.

The shoe 222 is shown with a plurality of eyelets 136 having a lace or a shoe string 140 laced through the plurality of eyelets. To wear the high-top shoe 222, the wearer can pull on the two overhang lace sections 142, 144 of the shoe lace 140 and then rather than tying a typical shoe lace knot to keep the lace in tension, the wearer can wrap the two overhang lace sections around the extended ankle support section 226 of the high-top shoe 222 until the hook engages the loop of the fastener element 162. The user can then repeat the steps with the second shoe of the pair of shoes 220.

With reference now to FIG. 7, the fastener element 162 of FIGS. 1-3 is more clearly shown with an opening 160 provided with the body 250 of the fastener element 162. The opening 160 can be formed with a puncher to create a hole near the first end 240 of the fastener element, opposite the second end 242 of the fastener element. The fastener element 162 can be formed with a back to back hook and loop element 163 or the body 250 can be formed by attaching a strip of hook element to a strip of a loop element, in an end-to-end or serial configuration, with or without an intermediate piece therebetween.

FIG. 8 shows a fastener element 162 that is similar to the fastener element 162 of FIG. 7 with a metal eyelet 246 to reinforce the opening 160 on the fastener element.

FIG. 9 depicts yet another fastener element 162 in accordance with further aspects of the present disclosure. As shown, the first end 240 of the fastener element 162 is wrapped around and attaches to the body 250 of the fastener element at an attached point 252, such as with stitching, sewing, bonding, and/or adhesive. This wrapped section 254 in combination with the attached point 252 forms a body loop 256 near the first end 240 of the fastener element 162. Two free ends of a lace can pass through the body loop 256 and then tied off to mechanically secure the lace to the fastener element of FIG. 9. The fastener element 162 of the present disclosure can be formed with a back to back hook and loop element 163 or the body 250 can be formed by attaching a strip of hook element to a strip of a loop element, in an end-to-end or serial configuration, with or without an intermediate piece therebetween. The first end 240 is shown spaced from an end-most point 258 of the body 250 of the fastener element 162.

With reference again to FIGS. 1 and 6, the fastener element 162 used herein can embody any of the fastener elements shown and described with reference to FIGS. 7-9.

In some examples, a lace can be laced through a plurality of eyelets on a shoe or a boxing glove differently than as shown in FIGS. 1-3 and 6 and is still usable with a fastener element 162 of the present invention. For example, the lace can be laced so that there is only one lace overhang and the one lace overhang connected to the fastener element 162 described elsewhere herein. In still other examples, the lace can have a different lacing pattern than the crossing pattern shown. In still other examples, after lacing a boxing glove or a shoe as described elsewhere herein, tape can be used to further secure the fastener element from inadvertently coming loose or coming undone.

FIG. 10 shows yet another fastener element 162 provided in accordance with further aspects of the present invention, which is usable with a lace 140 having two free ends 146, 148, as disclosed elsewhere herein. The present fastener element 162 is similar to the other fastener elements described elsewhere herein and uses a hook and loop element 163 but with some differences. In the present embodiment, a cover element 270 is attached to the body 250 of the fastener element 162, such as by stitching, sewing, adhesive, welding, or combinations thereof. The cover element 270 can be attached closer to the first end 240 of the body 250 than the second end 242 of the body. An opening 160 can be provided through both the cover element 270 and the body 250 of the fastener element 162 to receive one or two free ends of a lace 140 (FIG. 1). A reinforced metal eyelet can be included with the opening 160.

The cover element 270 can function as a smooth protective layer or surface and can embody any number of materials, including VELCRO compatible neoprene, neoprene, closed cell foam, polyester tricot loop, nylon knitted loop, nylon tricot, low pile loop fabric, unbroken loop fabric, Spandex and nylon jersey, Spandex and polyester Perfectex, Lycra fabric, heavy duty cotton, low density ethylene foam, and polyethylene foam. The cover element 270 is understood to have a relatively softer surface than that of the hook element and softer than the edges of the hook element or loop element. The cover element 270 can be incorporated so that when the lace 140 and fastener element 162 are wrapped around an object, such as around an extended ankle support system 226 of a shoe (FIG. 6) or around a base portion 120 of a boxing glove (FIG. 3), the cover element 270 does not scratch or otherwise damage the surfaces that the cover element comes into contact.

The cover element 270 can have a width that matches or closely corresponds to the width of the body 250 of the fastener element 162. The length of the cover element 270 can be selected so that some or all of the circumference to which the fastener element 162 wraps around, such as the base portion 120 of a boxing glove, contacts the cover element 270. In an example, the cover element 270 is attached to the hook side of a back-to-back hook and loop element 163, such as by stitching, sewing, bonding, adhesive, or combinations thereof.

The present fastener element 162 can include two edge liners 274, 274, one on each side edge 262, 262 of the fastener element 162. Each edge liner 274 can be a woven or non-woven cloth or fabric and can be attached to the respective side 262 of the body 250 by sewing, stitching, adhesive, bonding, or combinations thereof. In other examples, the two edge liners 274, 274 can be made from a thermoplastic foam material. The two edge liners 274, 274 can protect a user or wearer from the relatively hard surface of the edges of the body to prevent unwanted injuries or pain. The two edge liners 274, 274 can extend the remaining length of the body 250 along the two edges 262, 262 not covered by the cover element 270 or can extend the full length of the fastener element or any length in between. In an example, the two edge liners 274, 274 can be made from a polyester fabric or material.

Optionally, a gripper element 280 may be included at or near the second end 242 of the body 250. The gripper element 280 can be attached to the loop side of the fastener element so as to leave the hook side of the fastener element exposed at the second end 242 for securing against the loop element when the fastener element 162 is wrapped around an object, such as around the base of a boxing glove. When incorporated, the gripper element 280 provides a leverage point to facilitating separating the hook element from the loop element.

The gripper element 280, when incorporated, can embody a loop with a hole or opening in the middle thereof. In other examples, the gripper element 280 is an enlarged gripping structure or fabric for grabbing and pulling, with or without a loop. The gripper element 280 can be made from any number of materials, including from a woven or non-woven strip of fabric or cloth or from a string. In an example, the gripper element 280 is made from a polyester material.

FIG. 11 shows yet another fastener element 162 provided in accordance with further aspects of the present invention, which is usable with a lace 140 having two free ends 146, 148, as disclosed elsewhere herein. The present fastener element 162 is similar to the other fastener elements described elsewhere herein, such as the fastener element 162 of FIG. 10 with some differences. In the present embodiment, the gripper element 280 is omitted. Instead, a gripper pad 290 is provided at the second end 242. In an example, the gripper pad 290 is stitched, sewn, bonded, or glued to the body 250, including to the hook side of the fastener element. The gripper pad 290, which can have the same material as the cover element 270 or the edge liners 274, 274 or be made from a different material, can be used by the user or wearer to pry the hook from the loop of the fastener element to separate the fastener element from the object, such as from the boxing glove or shoe.

FIG. 12 shows yet another fastener element 162 provided in accordance with further aspects of the present invention, which is usable with a lace 140 having two free ends 146, 148, as disclosed elsewhere herein. The present fastener element 162 is similar to the other fastener elements described elsewhere herein, such as to the fastener element 162 of FIGS. 10 and 11 with some differences. In the present embodiment, the overall length of the fastener element 162 is made from at least two distinct materials or sections. The first section 302 can be made from a hook element 300 having a first end 240 and a second end 242. Optionally, the first section 302 can be a back-to-back hook/loop element. The second section 304 can be made from a loop element 310 with a built-in loop that is compatible with the hook element 300 of the first section 302 or from a loop element. For example, the loop element 310 can be a VELCRO hook/loop system or similar compatible neoprene, polyester tricot loop, nylon knitted loop, low pile loop fabric, unbroken loop fabric, etc. The second section 304 has a first end 318 attached to the first end 240 of the first section 302 and a second end 320 spaced from the first end 318. The first end 240 of the first section 302 and the first end 318 of the second section 304 can overlap and the stitching or sewing performed at the overlapped sections. The opening 160, which can be reinforced with a metal eyelet, is located closer to the second end 320 than to the first end 318 of the loop element 310. For simplicity, the first section 302 can be considered a hook element 300 and the second section 304 can be considered a loop element 310. A cover element 270, similar to those shown and described with reference to FIGS. 10 and 11, can be attached to the second section 304 to provide cushion, padding, or coverage upon contact with the shoe or boxing glove.

The first section 302 of the fastener element 162 may incorporate a gripper element 280 as described with reference to FIG. 10 or a gripper pad 290 as described with reference to FIG. 11. Optionally, the gripper element and the gripper pad can be omitted. The first section 302 and the second section 320 may attach to one another by stitching, sewing, bonding, adhesive or combinations thereof.

Thus, a fastener element described herein can have an overall length defined by a hook element, a loop element, or a combination hook/loop element. Optionally, an intermediate piece can be provided between a strip of a hook element and a strip of a loop element. The intermediate piece can be a stretchable material, an elastic belt, or a fabric. In other examples, the overall length of a fastener element can be defined by two or more distinct sections. For example, a length of the fastener element can be a loop element and another length of the fastener element can be a hook element, a loop element, or a combination hook/loop element.

Figure 13A:
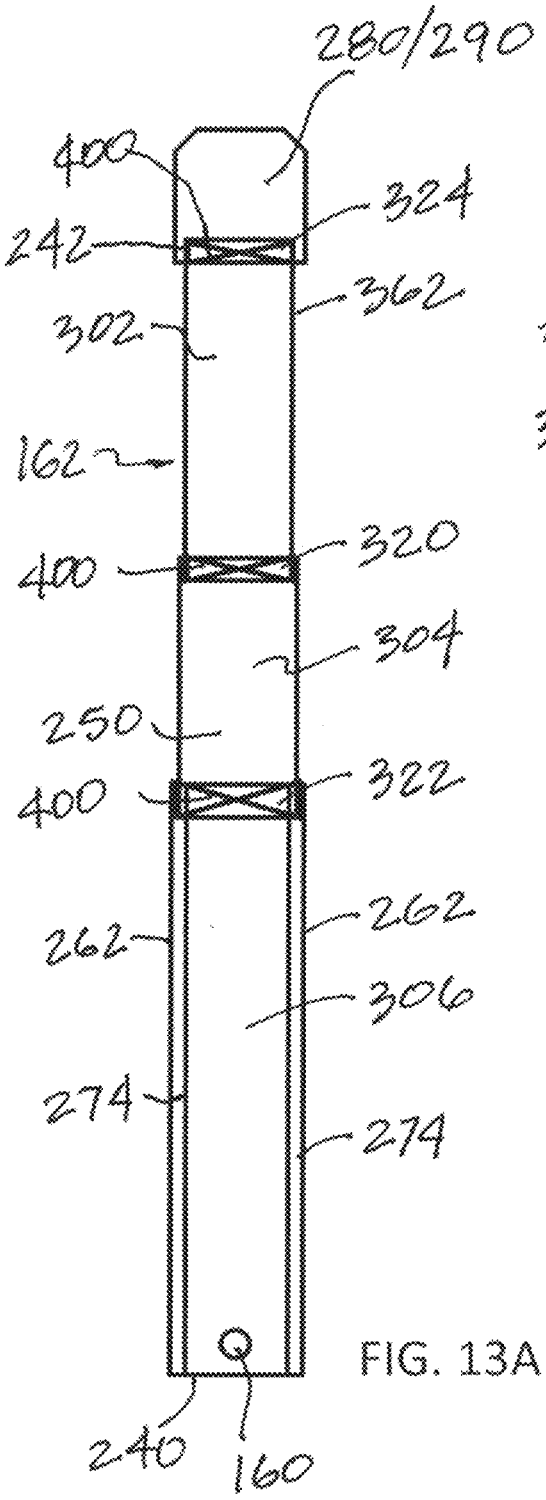
FIGS. 13A and 13B are schematic depictions of another embodiment of a fastener element.

With reference now to FIG. 13A, a fastener element 162 provided in accordance with further aspects of the present invention is shown, which is usable with a lace 140 having two free ends 146, 148, as disclosed elsewhere herein. The present fastener element 162 is similar to the other fastener elements described elsewhere herein, such as the fastener element 162 of FIGS. 10-12, and previously alluded to.

As shown, the fastener element 162 is made from a first section 302 attached to a second section 304, which is then attached to a third section 306. The first section 302 can overlap with the second section 304 at a first overlapped region 320. The first section 302 and the second section 304 can be secured together at the first overlapped region 320 by stitching, sewing, bonding, adhesive or combinations thereof, generally designated as 400.

The second section 304 can overlap with the third section 306 at a second overlapped region 322. The first section 302 and the second section 304 can be secured together at the second overlapped region 322 by stitching, sewing, bonding, adhesive or combinations thereof, generally designated as 400.

The fastener element 162 has a body 250 defined by the three sections 302, 304, 306. The body 250 has a first end 240 and a second end 242. An opening 160 can be provided with the body near the first end. The opening 160 can be a simple hole punched through the third section 306 or can be reinforced with a metal eyelet. A gripper element 280 or a gripper pad 290 can be provided and attached to the second end 242 of the body 250. In an example, the body 250 is provided with a gripper pad 290, which can overlap with the first section 302 at a third overlapped region 324. The first section 302 and the gripper element 280 or gripper pad 290 can be secured together at the third overlapped region 324 by stitching, sewing, bonding, adhesive or combinations thereof, generally designated as 400.

Figure 13B:
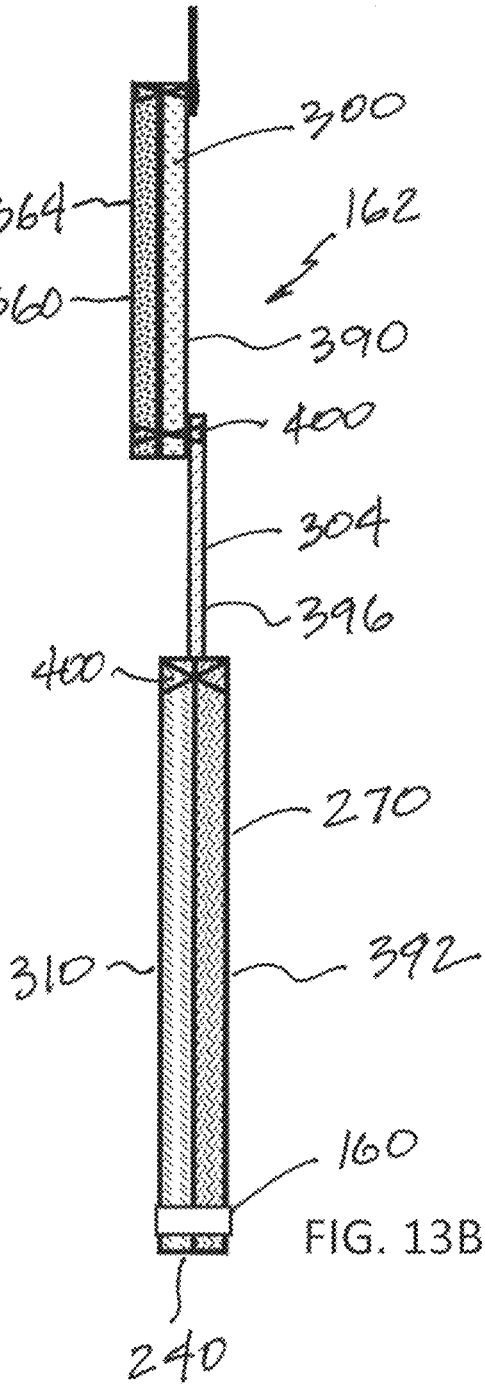

With continued reference to FIG. 13A and further reference to FIG. 13B, which is a schematic cross-sectional side view of FIG. 13A, the first section 302 can be made from a strip of a hook element 300 for attaching to a loop element. The length of the first section 302 can be about 3 inches to about 11 inches in length. The hook element 300 can optionally be provided with a backing material 360. The backing material 360 can attach to the hook element 300 around a perimeter 362 of the hook element, such as by stitching, sewing, bonding, adhesive, or combinations thereof.

In an example, the backing material can be made from a synthetic textile such as a from a nylon material, a polyester material or from Nomex. Optionally, the backing material 350 can be made from heavy duty cotton. In some examples, the exterior surface 364 of the backing material 360 can be printed or labeled with any number of information, such as manufacturer information, team logo, personalized prints, etc. When the fastener element 162 of FIGS. 13A and 13B is put to use, the exterior surface 352 and the optional printed information can be exposed and visually detectable.

In an example, the second section 304 can have a structure or body that is stretchable. For example, the second section 304 can be made from a stretchable material, an elastic belt, from Lycra, from Spandex, from Nylon Lycra fabric, or similar two dimensional or four dimensional stretchable fabrics. The second section 304, which can also be referred to as an intermediate piece, can have a length of between about 1.5 inches to about 6 inches. The second section 304 can comprise a strip of stretchable material. In some examples, the second section 304 can comprise two or more overlapping stretchable strips to increase the bulk and biasing capabilities of the second section.

The third section 306 is shown having two side edges 262 with each of the two side edges having an edge liner 274 attached thereto, similar to that of FIGS. 10-12. The third section 306 can include a trip of a loop element 310 and a cover element 270. The cover element 270 is similar to cover elements described elsewhere herein, such as the cover element 270 of FIGS. 10-12. A through hole or eyelet 160, which can be a punched hole or a metal reinforced eyelet, is provided near an end of the third section 306. Overhang lace sections of a lace can project through the eyelet 160 and secured thereto by knotting, as previously discussed. In some examples, there can be two or more eyelets for coupling with the overhang lace sections.

As shown, the hook element 300 is oriented in a first direction while the loop element 310 is oriented in a second direction, opposite the first direction. This arrangement allows the fastener element 162 shown in FIG. 13B to wrap around an object, such as a boxing glove, with the cover element 270 in contact with the object so that the loop element 310 is exposed for engagement by the hook element 300. The length of the third section 306 can be approximately 6 inches to about 14 inches.

In an example, the second section or intermediate piece 304 projects between the cover element 270 and the loop element 310 of the third piece 306 and then secured between the two by stitching, sewing, bonding, adhesive or combinations thereof. In other examples, the intermediate piece 304 can lie over or under the third section 306 and not between the cover element 270 and the loop element 310 of the third piece 306.

The fastener element 162 of FIGS. 13A and 13B is usable with a lace and maintaining tension on the lace as described elsewhere herein.

The fastener element 162 of FIGS. 13A and 13B can be viewed as having a first portion 390 configured for attaching to a second portion 392 of the fastener element. The first portion 390 of the fastener element is attached to an intermediate piece 396 and the second portion 392 of the fastener element 162 is attached to the intermediate piece 396. The first portion 390 and the second portion 392 are attached to one another through the intermediate piece 396. The intermediate piece 396 can comprise a single element or a single body or more than one element. The first portion 390 and the second portion 392 are indirectly attached to one another. Optionally, the first portion 390 and the second portion 392 are directly attached to one another and the intermediate piece 396 is omitted.

Figure 14:
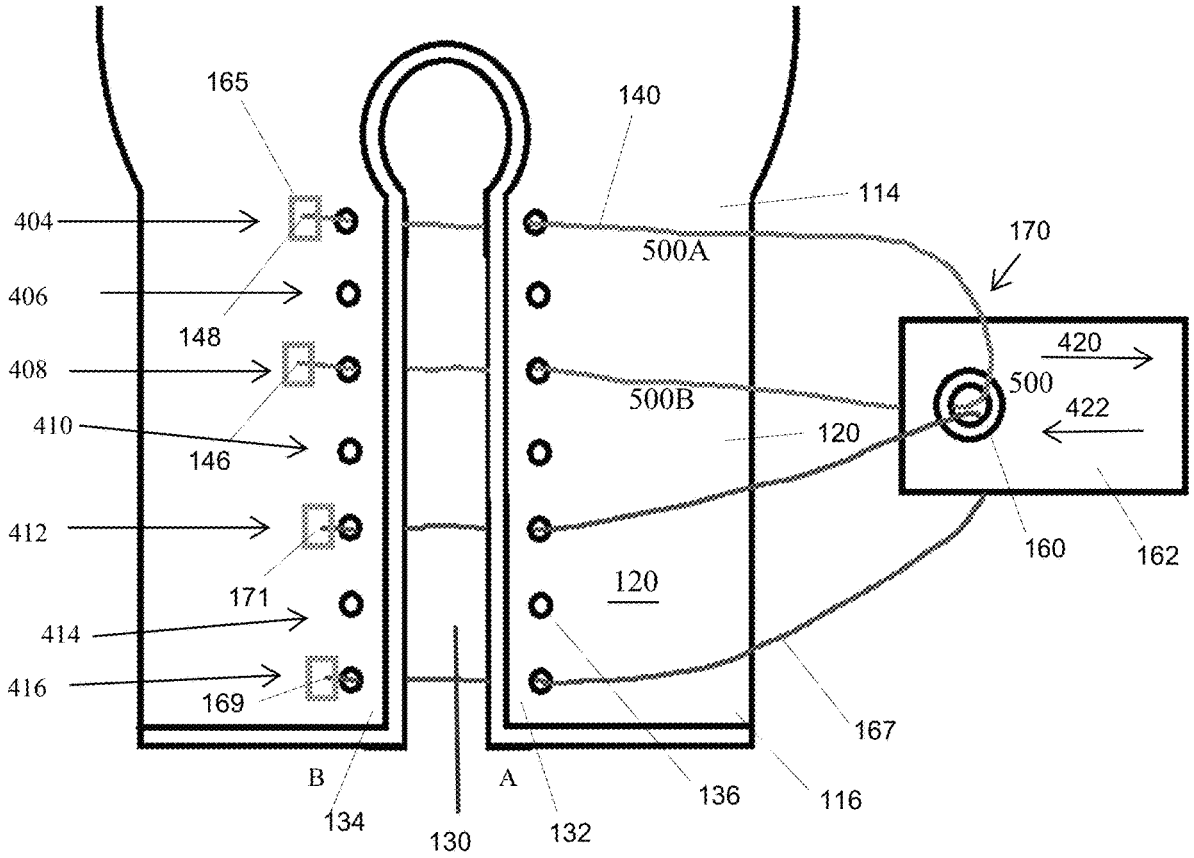
FIG. 14 is a schematic depiction of another embodiment of the boxing glove with a tying system or mechanism in accordance with further aspects of the invention.

With reference now to FIG. 14, a partial schematic depiction of another embodiment of the boxing glove with one or more laces attached to a tying mechanism or fastener element 162 is shown. The boxing glove and the tying mechanism of the present embodiment are similar to other embodiments discussed elsewhere herein with the exception of the one or more laces and the fastener element, which have been coupled together to operate with a modified tensioning pattern, as further discussed below. As shown, the plurality of eyelets 136 are located on the base portion 120 of the boxing glove, which can be a right-handed glove 102 or a left-handed glove 104. The base portion 120 is defined by the wrist portion 114 and the opening portion 116 of the boxing glove. The base portion 120 comprises two flaps 132, 134 where each flap contains a column of eyelets 136 and there exists a slit, channel or gap 130 between the two flaps. Each flap 132, 134 may comprise any number of eyelets 136. In an example, each flap 132, 134 may comprise between four to eight eyelets 136 orientated in a column. The eyelets 136 on one flap 132 may align with corresponding eyelets 136 on the opposing flap 134 so that the two columns of eyelets from the two flaps can have four to eight pairs of eyelets aligned in rows. Other eyelet arrangements, numbers, and alignments are contemplated.

In an example, a lace tightening system or mechanism 170 may be used to tighten the base portion 120 around the boxer's wrist, and possibly the forearm depending on how far up the arm the base portion 120 seats. The tightening system or mechanism 170 may comprise a first lace 140, a second lace 167, and a fastener element 162. The fastener element 162 may comprise a hole or opening 160 and other features described elsewhere herein, such as a metal eyelet. The first lace 140 and the second lace 167 may lace through the eyelets 136 of the base portion 120 and the hole or opening 160 of the fastener element 162 and be used as means for creating tension, as further discussed below.

For nomenclature purposes, the eyelets 136 have been assigned indicator A or B and one of rows 404-416. Thus, the first eyelet closest to the palm section of the boxing glove on the first flap 132 is designated 404A while the last eyelet on the second flap 134 is designated 416B.

In an example, each of the first lace 140 and the second lace 167 passes through at least two eyelet rows located on the two flaps 132, 134 and through the hole 160 of the fastener element 162. The at least two eyelet rows that each lace passes through may be considered a set of eyelet rows. To secure an end of each lace to the boxing glove, at least one locking mechanism 165 is incorporated to anchor or lock some or all the free ends of the laces 140, 167 at or near the eyelets 136 so that tension can be created around the base portion 120.

A locking mechanism 165 can be a physical element or component, such as a ring, a washer, or a nut, which can be made from plastic, metal, a thermoplastic elastomer, an elastomer, or combinations thereof. In an example, the locking mechanisms 165 may have an inner part and an external part where the inner part is made of a hard material and the external part is made of a soft material. The locking mechanisms 165 may be attached on the outside or inside surface of the boxing glove around or near the eyelets 136. The locking mechanism 165 can have an outer physical profile or contour with a dimension that is larger than the opening of an eyelet 136 to prevent passing through the eyelet, and to thereby serve as an anchor or lock for the lace. The locking mechanism 165 can have a through passage to receive a free end of one of the laces. As an example, after passing through the through passage of the locking mechanism 165, the first free end 146 of the first lace 140 can be knotted to the locking mechanism 165 to secure the first free end 146 from passing through the eyelet. As shown, the first lace 140 has free ends that pass through eyelets 408A, 408B and eyelets 404A, 404B and connected to corresponding locking mechanisms 165, and the second lace 167 has free ends that pass through eyelets 412A, 412B and eyelets 416A, 416B and connected to corresponding locking mechanisms 165. In an example, the anchoring feature of the locking mechanisms 165 may lock the free ends of the first and second laces 140, 167 to prevent the movement of the ends in any direction. In another example, the locking mechanisms 165 may only prevent the movement of the laces 140, 167 in the direction where the laces would unwind from the eyelets 136.

In an alternative example, the locking mechanisms 165 can be omitted. For example, after passing the first free end 146 through eyelets 408A, 408B and the second free end 148 through eyelets 404A, 404B, and the lace 140 through the opening 160 of the fastener element 162, the two free ends 146, 148 can be tied to one another without any locking mechanism. Optionally, the second lace 167 can be secured to the boxing glove in the same manner without any locking mechanism. In another example, at least one locking mechanism 165 may be used with free ends that are tied together. Once the free ends are secured to the boxing glove as described, such as to the flaps 132, 134, the user can pull on the fastener element 162 to first wrap the two laces 140, 167 around the base portion 120 of the glove and then continuing to wrap the fastener element 162 around the base portion 120 so that hooks engage the loops of the fastener element 162, as described elsewhere herein. In an example, the user creates tension by first pulling the fastener element 162 in the first direction, along arrow 420, and then wrapping the laces 140, 167 and the fastener element 162 around the base portion 120 as described. In another example, the user creates tension by pulling the fastener element 162 in the second direction 422 to close up the gap at the elongated channel, slit, or gap 130 and then wrapping the laces 140, 167 and the fastener element 162 around the base portion 120 as described.

The tightening system or mechanism 170 of the present embodiment therefore uses two laces to form four anchor points at eyelets 404B, 408B, 412B, 416B to create tension around the base portion 120 of the glove. The four anchor points are spaced apart along the two flaps 132, 134 and allow a person to self-tighten the boxing glove with relatively uniform tension along the length of the elongated slit 130 with the two flaps 132, 134, even if the person's tying hand is located inside another boxing glove. Among other things, the present tightening system or mechanism 170 allows tightening forces to be generated generally radially of the lengthwise axis defined by the elongated channel 130 to generate tension around the base portion 120. While only certain eyelets are used to secure the laces as described, in other embodiments, different eyelets, additional eyelets, or fewer eyelets may be used, such as with a third lace passing through the unused eyelets, by passing the existing laces through the unused eyelets, or by passing the existing laces through different pairs or different sets of eyelets.

In an alternative example, the first lace 140 may be routed through the eyelets in the following pattern: securing free end 148 to a locking mechanism 165 at eyelet 404B, then passing the lace 140 through eyelet 404A, through opening 160, through eyelet 406A, through eyelet 406B, through eyelet 408B, through eyelet 408A, back through opening 160, through eyelet 410A, through eyelet 410B, and then tying the free end 146 to a second locking mechanism 165 at eyelet 410B. Alternatively, the two free ends 146, 148 can be tied together without using any locking mechanism 165. The second lace 167, in the present alternative embodiment, may be routed through the eyelets as shown in FIG. 14, optionally with the two free ends tied together without any locking mechanism. Thus, the alternative embodiment may use two laces of two different lengths.

In another alternative example, the second lace 167 may be routed through the eyelets in the following pattern: securing free end 171 to a locking mechanism 165 at eyelet 410B, then passing the lace 167 through eyelet 410A, through opening 160, through eyelet 412A, through eyelet 412B, through eyelet 414B, through eyelet 414A, back through opening 160, through eyelet 416A, through eyelet 416B, and then tying the free end 169 to a second locking mechanism 165 at eyelet 416B. Alternatively, the two free ends 169, 171 can be tied together without using any locking mechanism. The first lace 140, in the present alternative embodiment, may be routed through the eyelets as shown in FIG. 14, optionally with the two free ends tied together without any locking mechanism. Thus, the alternative embodiment may use two laces of two different lengths.

The orientation of the first lace 140 and the second lace 167 may vary relative to each other or to the different parts of the base portion 120. In an example, the first lace 140 may occupy the upper portion of the base portion 120 by lacing through eyelets 136 occupied near or within the wrist portion 114, for example the eyelet rows 404-408. The second lace 167 may occupy the lower portion of the base portion 120 by lacing through eyelets 136 occupied near or within the opening portion 116, for example the eyelet rows 412-416. In another example, the first lace 140 and the second lace 167 may be intertwined with each other, where the free end 146 of the first lace 140 passes through a pair of eyelet rows that is in between the free ends 169, 171 of the second lace 167. In another example, the terminals ends 146, 148 of the first lace 140 may both be located in between the terminal ends 169, 171 of the second lace 167.

In still yet another example, the tightening system or mechanism 170 may comprise only a single lace 140 used to tighten the base portion 120 around the boxer's wrist, and possibly the forearm, using a similar lacing mechanism as described elsewhere herein. In an example, the single lace 140 passes through at least two eyelet rows located on the two flaps 132, 134 and through the hole or opening 160 of the fastener element 162. To secure the ends of the single lace 140 to the boxing glove, at least one locking mechanism 165 is incorporated to anchor or lock one or both free ends of the single lace 140 at or near the eyelets 136 so that tension can be created around the base portion 120.

The single lace 140 has a first free end 146 that can pass through eyelets 416A, 416B, and a second free end 148 that may pass through eyelets 404A, 404B and the two free ends can connect to corresponding locking mechanisms 165. After passing through the through passage of the respective locking mechanisms 165, the first and second free ends 146, 148 can be knotted to the respective locking mechanisms 165 to secure the first and second free ends 146, 148 from passing through the eyelets. In another example, the first and second free ends 146, 148 may pass through eyelet rows closer to the middle of the base portion 120. For example, the first free end 146 may pass through eyelets 412A, 412B, and the second free end 148 may pass through eyelets 406A, 406B and connect to corresponding locking mechanisms 165. In an alternative example, the locking mechanisms can be omitted where after passing the first and second free ends 146, 148 through their corresponding eyelet rows, and the single lace 140 through the opening 160 of the fastener element 162, the two free ends 146, 148 can be tied to one another without any locking mechanism.

In an example, the single lace 140 may be routed through the eyelets in the following pattern: securing second free end 148 to a locking mechanism 165 at eyelet 404B, then passing the lace 140 through eyelet 404A, through opening 160, through eyelet 408A, through eyelet 408B, through eyelet 412B, through eyelet 412A, back through opening 160, through eyelet 416A, through eyelet 416B, and then tying the first free end 146 of the single lace to a second locking mechanism 165 at eyelet 416B. Alternatively, the two free ends 146, 148 of the single lace can be tied together without using any locking mechanism 165. In another alternative example, the single lace 140 may route through all the eyelet rows 404-416 in the pattern as described, where the single lace passes through the opening 160 in an alternating pattern when passing through the eyelet rows.

Once the free ends are secured to the boxing glove as described, such as to the flaps 132, 134, the user can pull on the fastener element 162 with a force that is generally radial of the lengthwise axis defined by the elongated channel, slit, or gap 130 to first wrap the single lace 140 around the base portion 120 of the glove and then continuing to wrap the fastener element 162 around the base portion 120 to engage the hooks with the loops of the fastener element 162, as described elsewhere herein. In an example, the user creates tension by first pulling the fastener element 162 in the first direction, along arrow 420, and then wrapping the single lace 140 and the fastener element 162 around the base portion 120 as described. In another example, the user creates tension by pulling the fastener element 162 in the second direction 422 to close up the gap at the elongated channel 130 and then wrapping the single lace 140 and the fastener element 162 around the base portion 120 as described.

In some examples, whether the lace tightening system 170 uses a single lace or more than one lace, the free ends may be tied to together at a location underneath the first flap 132 or the second flap 134 so that the one or more knots are not exposed from the upper or exterior of the flaps. Similarly, if the free ends of the one or more laces are secured to the flaps using one or more locking mechanisms 165, the securement of the free ends with the one or more locking mechanisms 165 may be located underneath the first flap 132 or the second flap so that the one or more locking mechanisms 165 are not exposed from the upper or exterior of the flaps.

In some examples, whether the lace tightening system 170 uses a single lace or more than one lace, each of the lace that passes through the through hole of the fastener has at least one apex or point that join two adjacent lace sections of the lace. For example, as shown in FIG. 14, the first lace 140 is anchored to the flap 134 at eyelets 404B and 408B and wherein an apex 500 joins the first section 500A and the second section 500B of the first lace 140. The apex 500 is located laterally to the same side of both the first flap 132 and the second flap 134 so that the fastener element 162 can be pulled laterally of the lengthwise axis defined by the slit or gap 130 to create tension around the base portion 120 of the boxing glove. In some examples, there can be more than one apices or points of the singe lace or from two or more laces located at one or more through holes of the fastener element.

Figure 15:
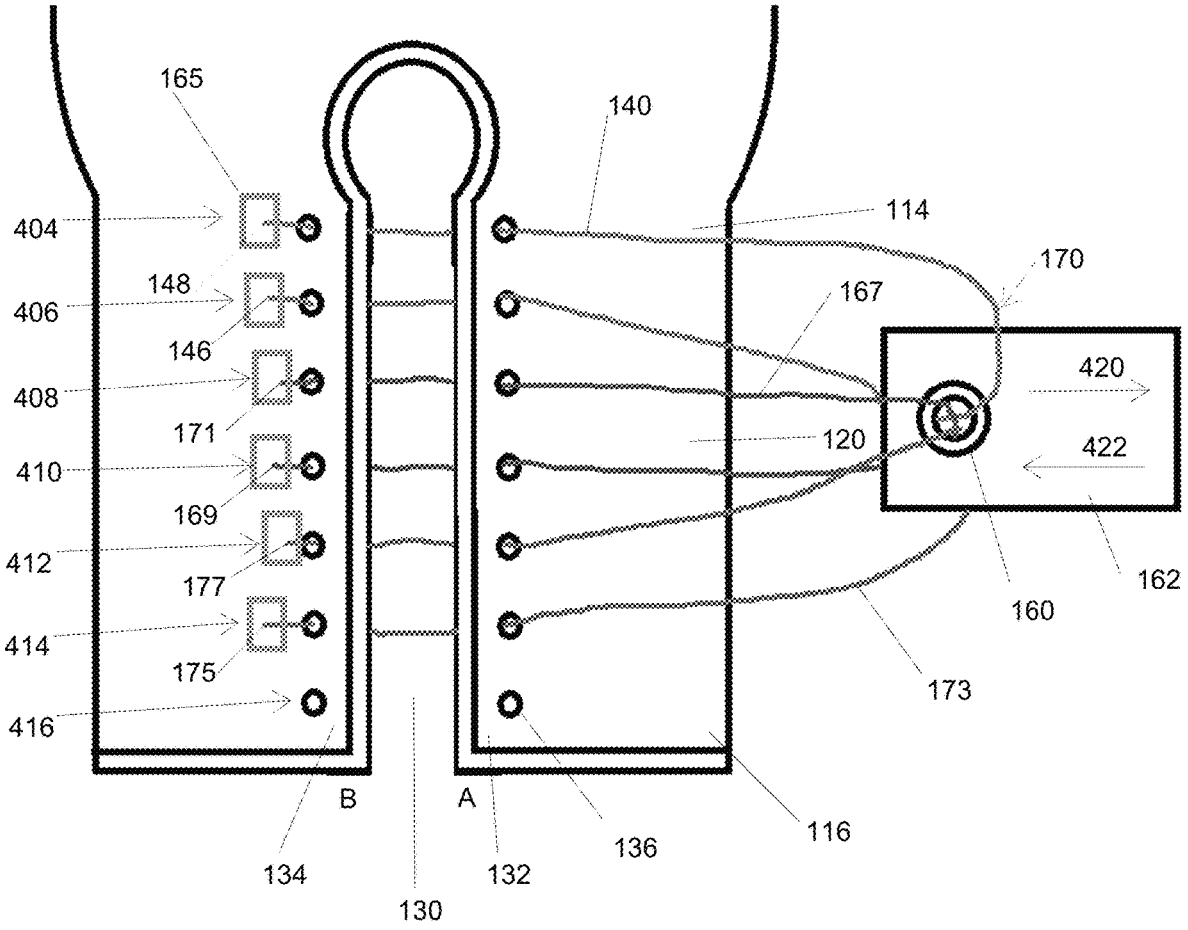
FIG. 15 is yet another embodiment of a boxing glove with a tying system or mechanism.

With reference now to FIG. 15, a partial schematic depiction of another embodiment of the boxing glove with a plurality of laces attached to a tying mechanism or fastener element 162 is shown. The boxing glove and the tying mechanism of the present embodiment are similar to other embodiments discussed elsewhere herein with the exception of the plurality of laces and the fastener element, which have been coupled together to operate with a modified tensioning pattern, as further discussed below. As shown, the plurality of eyelets 136 are located on the base portion 120 of the boxing glove, which can be a right-handed glove 102 or a left-handed glove 104. The base portion 120 is like the other embodiments of the boxing glove described elsewhere herein. Mainly, the plurality of eyelets 136 may be orientated in columns where the column of eyelets on one flap 132 may align with corresponding column of eyelets on the opposing flap 134.

In the present embodiment, the tightening system or mechanism 170 comprises a first lace 140, a second lace 167, a third lace 173, and a fastener element 162. The fastener element 162 may comprise a hole or opening 160 and other features described elsewhere herein, such as a metal eyelet. The first lace 140, second lace 167, and third lace 173 may lace through the eyelets 136 of the base portion 120 and the hole or opening 160 of the fastener element 162 and be used as means for creating tension, as further discussed below.

In an example, each of the first lace 140, second lace 167, and third lace 173 passes through at least two eyelet rows located on the two flaps 132, 134 and through the hole 160 of the fastener element 162. The at least two eyelet rows that each lace passes through may be considered a set of eyelet rows. In an example, the first lace 140 has a first free end 146 that can pass through eyelets 406A, 406B, and a second free end 148 that can pass through eyelets 404A, 404B, and the two free ends can connect to corresponding locking mechanisms 165. Similarly, the second lace 167 has a first free end 169 that can pass through eyelets 410A, 410B, and a second free end 171 that can pass through eyelets 408A, 408B, and the two free ends can connect to corresponding locking mechanisms 165. Finally, the third lace 173 has a first free end 175 that can pass through eyelets 414A, 414B, and a second free end 177 that can pass through eyelets 412A, 412B, and the two free ends can connect to corresponding locking mechanisms 165. In another example, the first free end 175 of the third lace 173 may pass through eyelets 416A, 416B as shown in FIG. 16.

To secure an end of each lace to the boxing glove, at least one locking mechanism 165 is incorporated to anchor or lock some or all the free ends of the laces 140, 167, 173 at or near the eyelets 136 so that tension can be created around the base portion 120. A similar locking mechanism 165 described elsewhere herein may be used to anchor some or all of the free ends of the laces 140, 167, 173. In an example, after passing through the through passage of the respective locking mechanisms 165, the free ends of the laces 140, 167, 170 can be knotted to the respective locking mechanisms 165 to secure the free ends from passing through the eyelets. In an alternative example, the locking mechanisms 165 can be omitted. For example, after passing the first free end 146 through eyelets 406A, 406B and the second free end 148 through eyelets 404A, 404B, and the lace 140 through the opening 160 of the fastener element 162, the two free ends 146, 148 can be tied to one another without any locking mechanism. Optionally, the second and third laces 167, 173 can be secured to the boxing glove in the same manner without any locking mechanism. In another example, at least one locking mechanism 165 may be used with free ends that are tied together.

Once the free ends are secured to the boxing glove as described, such as to the flaps 132, 134, the user can pull on the fastener element 162 with a force that is generally radial of the lengthwise axis defined by the elongated channel 130 to first wrap the three laces 140, 167, 173 around the base portion 120 of the glove and then continuing to wrap the fastener element 162 around the base portion 120 to engage the hooks with the loops of the fastener element 162, as described elsewhere herein. In an example, the user creates tension by first pulling the fastener element 162 in the first direction, along arrow 420, and then wrapping the three laces 140, 167, 173 and the fastener element 162 around the base portion 120 as described. In another example, the user creates tension by pulling the fastener element 162 in the second direction 422 to close up the gap at the elongated channel 130 and then wrapping the three laces 140, 167, 173 and the fastener element 162 around the base portion 120 as described. The tightening mechanism 170 of the present embodiment therefore uses three laces to form six anchor points at eyelets 404B, 406B, 408B, 410B, 412B, and 414B to create tension around the base portion 120 of the glove. The six anchor points are spaced apart along the two flaps 132, 134 and allow a person to self-tighten the boxing glove with relatively uniform tension along the length of the elongated slit 130 with the two flaps 132, 134, even if the person's tying hand is located inside another boxing glove. While only certain eyelets are used to secure the laces as described, in other embodiments, different eyelets, additional eyelets, or fewer eyelets may be used, such as with a fourth lace passing through the unused eyelets, by passing the existing laces through the unused eyelets, or by passing the existing laces through different pairs or different sets of eyelets.

Figure 16:
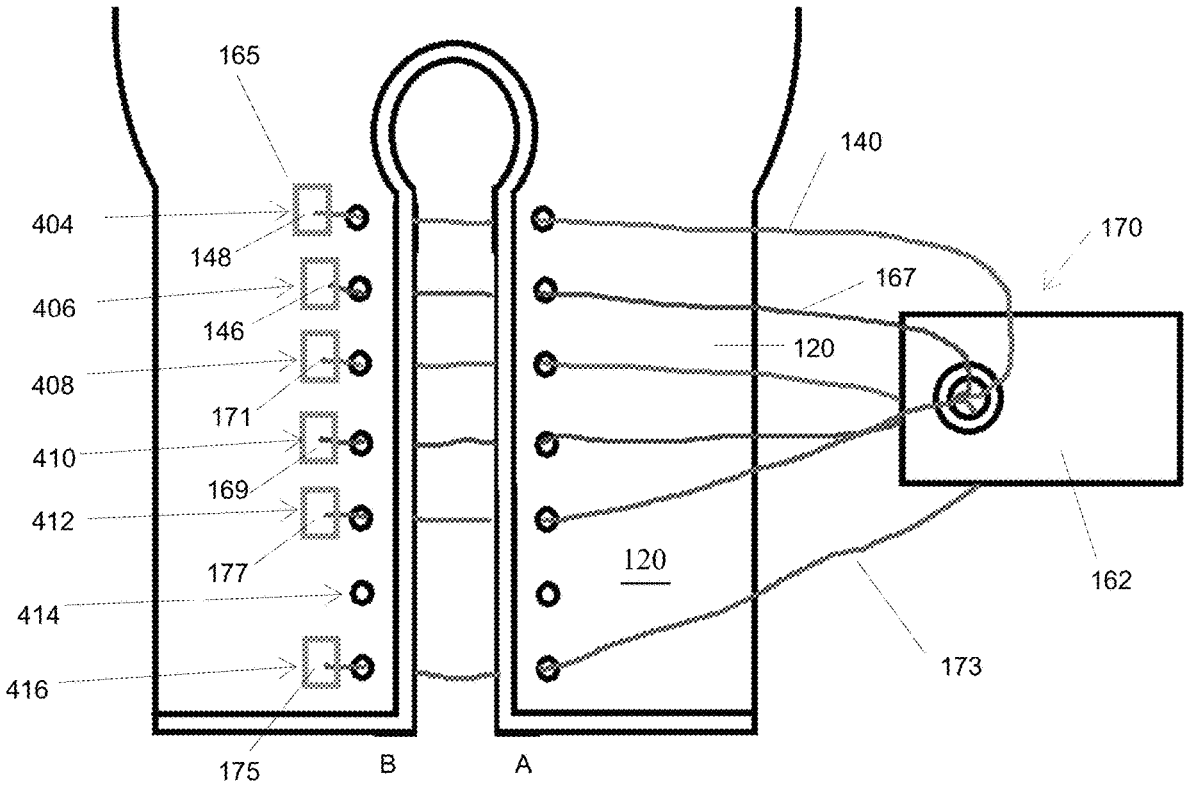
FIG. 16 is still yet another embodiment of a boxing glove with a tying system or mechanism.

With reference now to FIG. 16 along with FIG. 15, a partial schematic depiction of another embodiment of the boxing glove with a plurality of laces attached to a tying mechanism or fastener element 162 is shown. The orientation of the plurality of laces 140, 167, 173 may vary relative to each other or to the different parts of the base portion 120. In an example as shown in FIG. 15, the first lace 140 may occupy the upper portion of the base portion 120 by lacing through eyelet rows 404-406. The second lace 167 may occupy the middle portion of the base portion 120 by lacing through eyelet rows 408-410. The third lace 173 may occupy the lower portion of the base portion 120 by lacing through some or all of the eyelet rows 412-416.

In another example as shown in FIG. 16, at least two of the three laces 140, 167, 173 may be intertwined with each other. The free end 146 of the first lace 140 may pass through a pair of eyelet rows that is in between the free ends 169, 171 of the second lace 167. In another example, the free end 146 of the first lace 140 may pass through a pair of eyelet rows that is in between the free ends 175, 177 of the third lace 167, and the free end 177 of the third lace 173 may pass through a pair of eyelet rows that is in between the free ends 169, 171 of the second lace 167, so that all three laces are intertwined. In another example, the free ends of the first lace and second lace 140, 167 may both be located in between the terminal ends 175, 177 of the third lace 173, where the free ends 175, 177 occupy the outer eyelet rows 404 and 416.

Broadly speaking, the tightening system or mechanism of the present invention uses at least one lace, but can use two or more laces, with a fastener element 162 to tighten around the base portion of a boxing glove by allowing the fastener element 162 to be pulled laterally of a lengthwise gap defined by the two flaps to take up the gap and exert a tension on the base portion of the boxing glove. The length of the one or more laces can then wrap around the base portion and then the wrapping continues so that the hooks can engage the loops of the fastener element.

In some examples, one or more locking mechanisms may be used to anchor free ends of the one or more laces at the eyelets. In other examples, the free ends can be knotted to one another to eliminate or reduce the number of locking mechanisms.

Thus, aspects of the invention are understood to include a boxing glove with a tightening system or mechanism for allowing a lateral or radial force to be generated, radial of the lengthwise axis defined by the gap between the two flaps, and a tightening mechanism with at least one lace, one fastening element, and optionally one locking mechanism. A further aspect of the invention is a method for creating a tension around the base portion of a boxing glove by generating a force radial or lateral to a lengthwise axis defined by a gap between two flaps of a boxing glove.

Methods of making and of using tightening systems, fastener elements, and components thereof of the present disclosure are within the scope of the present invention.

Although limited embodiments of the lace, anchoring mechanisms or fastener elements, boxing gloves, and shoes and their components have been specifically described and illustrated herein, many modifications and variations will be apparent to those skilled in the art. Accordingly, it is to be understood that the lace, tying mechanisms, boxing gloves, and shoes and their components constructed according to principles of the disclosed device, system, and method may be embodied other than as specifically described herein. The disclosure is also defined in the following claims.

What is claimed is:

1. A boxing glove with a lace tensioning pattern, said boxing glove comprising:

a body with a finger portion, a palm portion, a thumb portion, and a base portion;

the base portion having an opening portion and a slit located between two flaps, including a first flap and a second flap, said opening portion is sized and shaped to receive a hand and said slit defining a lengthwise axis;

a plurality of laces attached to the body, including a first lace and a second lace;

the first lace having a first free end and a second free end secured to the base portion of the boxing glove, the first lace passing through a first eyelet and a second eyelet on the base portion to create an apex between the first free end and the second free end of the first lace;

the second lace having a first free end and a second free end secured to the base portion of the boxing glove, the second lace passing through a third eyelet and a fourth eyelet on the base portion to create an apex between the first free end and the second free end of the second lace;

a fastener element having a body and having the apex of the first lace secured to the body of the fastener element and the apex of the second lace secured to the body of the fastener element;

a hook and loop system for securing the fastener element to the base portion of the boxing glove;

the first lace and the second lace projecting in a first direction radially of the lengthwise axis defined by the slit so that the fastener element can be pulled in a second direction radial to the lengthwise axis; and wherein the first lace and the second lace are slidable relative to the first, second, third, and fourth eyelets.

2. The boxing glove with the lace tensioning pattern of claim 1, wherein the first and second free ends of the first lace and the second lace are secured to the first flap.

3. The boxing glove with the lace tensioning pattern of claim 2, wherein the first, second, third, and fourth eyelets are located on the second flap.

4. The boxing glove with the lace tensioning pattern of claim 1, wherein the apex of the first lace and the apex of the second lace are aligned at the fastener element.

5. The boxing glove with the lace tensioning pattern of claim 1, wherein the hook and loop system comprises a hook located on the fastener element and a loop located on the base portion of the boxing glove.

6. The boxing glove with the lace tensioning pattern of claim 1, wherein:

a third lace having a first free end and a second free end is secured to the base portion of the boxing glove, the third lace passing through a fifth eyelet and a sixth eyelet on the base portion to create an apex between the first free end and the second free end of the third lace;

wherein the apex of the third lace is secured to the body of the fastener element;

wherein the third lace projects in a first direction radially of the lengthwise axis defined by the slit so that the fastener element can be pulled in a second direction radial to the lengthwise axis; and wherein the third lace is slidable relative to the fifth and sixth eyelets.

7. The boxing glove with the lace tensioning pattern of claim 1, wherein the hook and loop system comprises a hook located on the fastener element and a loop located on the base portion of the boxing glove.

8. The boxing glove with the lace tensioning pattern of claim 1 being a left-handed glove and located adjacent a right-handed glove.

9. The boxing glove with the lace tensioning pattern of claim 8, wherein the right-handed glove has a body with a finger portion, a palm portion, a thumb portion, and a base portion;

the base portion of the right hand-glove having an opening portion and a slit located between two flaps, including a first flap and a second flap, said opening portion is sized and shaped to receive a right-hand and said slit defining a lengthwise axis;

a plurality of laces attached to the right-handed glove, including a first lace and a second lace;

the first lace having a first free end and a second free end secured to the base portion of the boxing glove, the first lace passing through a first eyelet and a second eyelet on the base portion to create an apex between the first free end and the second free end of the first lace the second lace having a first free end and a second free end secured to the base portion of the boxing glove, the second lace passing through a third eyelet and a fourth eyelet on the base portion to create an apex between the first free end and the second free end of the second lace;

a fastener element having a body and having the apex of the first lace secured to the body of the fastener element and the apex of the second lace secured to the body of the fastener element;

a hook and loop system for securing the fastener element to the base portion of the boxing glove;

the first lace and the second lace projecting in a first direction radially of the lengthwise axis defined by the slit so that the fastener element can be pulled in a second direction radial to the lengthwise axis; and wherein the first lace and the second lace are slidable relative to the first, second, third, and fourth eyelets.

10. The boxing glove with the lace tensioning pattern of claim 1, wherein the two ends of the first lace are anchored to the first flap by two spaced apart locking mechanisms.

11. A method of lacing a boxing glove for self-use by a boxer comprising:

passing a first lace through a first eyelet and a second eyelet on a base portion of a boxing glove to create an apex between a first free end and a second free end of the first lace, said boxing glove comprising a body with a finger portion, a palm portion, a thumb portion, and the base portion, wherein the base portion having an opening portion and a slit located between two flaps, including a first flap and a second flap;

passing a second lace through a third eyelet and a fourth eyelet on the base portion of the boxing glove to create an apex between a first free end and a second free end of the second lace;

securing the apex of the first lace and the apex of the second lace to a body of a fastener element having a length and a width;

providing a hook and loop system for securing the fastener element to the base portion of the boxing glove;

projecting first lace and the second lace in a first direction radially of the lengthwise axis defined by the slit such that the fastener element can be pulled in a second direction to at least wrap around the base portion; and wherein the first lace and the second lace are slidable relative to the first, second, third, and fourth eyelets.

12. The method of claim 11, further comprising securing the first and second free ends of the first lace and the second lace to the first flap.

13. The method of claim 11, wherein the first, second, third, and fourth eyelets are located on the second flap.

14. The method of claim 11, wherein the apex of the first lace and the apex of the second lace are aligned at the fastener element.

15. The method of claim 11, wherein the hook and loop system comprises a hook located on the fastener element and a loop located on the base portion of the boxing glove.

16. The method of claim 11, further comprising passing a third lace through a fifth eyelet and a sixth eyelet on the base portion of the boxing glove to create an apex between a first free end and a second free end of the third lace.

17. The method of claim 16, further comprising securing a first free end and a second free end of the third lace to the base portion of the boxing glove.

18. The method of claim 17, wherein the apex of the third lace is secured to the body of the fastener element.

19. The method of claim 18, wherein the third lace is slidable relative to the fifth and sixth eyelets.

20. The method of claim 11, wherein the boxing glove is a left-handed glove and is located adjacent a right-handed glove.

21. The method of claim 20, wherein the right-handed glove has a body with a finger portion, a palm portion, a thumb portion, and a base portion.

22. The method of claim 21, wherein the right-handed glove further comprising:

a first lace passing through a first eyelet and a second eyelet on the base portion of the right-handed boxing glove and an apex is located between a first free end and a second free end of the first lace, and wherein the base portion having an opening portion and a slit located between two flaps, including a first flap and a second flap;

a second lace passing through a third eyelet and a fourth eyelet on the base portion of the boxing glove and an apex is located between a first free end and a second free end of the second lace; and wherein the apex of the first lace and the apex of the second lace is secured to a body of a fastener element having a length and a width.

23. The method of claim 22, wherein the first lace and the second lace are located extend in a first direction radially of the lengthwise axis defined by the slit such that the fastener element can be pulled in a second direction to at least wrap around the base portion of the right-handed boxing glove.

24. The method of claim 23, wherein the first lace and the second lace are slidable relative to the first, second, third, and fourth eyelets.

25. The method of claim 11, wherein the two ends of the first lace are anchored to the first flap by two spaced apart locking mechanisms.

* * * * *